US011273638B2

(12) United States Patent
Nakagawa

(10) Patent No.: US 11,273,638 B2
(45) Date of Patent: Mar. 15, 2022

(54) LIQUID DISCHARGE HEAD AND LIQUID DISCHARGE MODULE

(71) Applicant: CANON KABUSHIKI KAISHA, Tokyo (JP)

(72) Inventor: Yoshiyuki Nakagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/143,966

(22) Filed: Jan. 7, 2021

(65) Prior Publication Data

US 2021/0229442 A1 Jul. 29, 2021

(30) Foreign Application Priority Data

Jan. 27, 2020 (JP) ..... JP2020-011242

(51) Int. Cl.
*B41J 2/14* (2006.01)

(52) U.S. Cl.
CPC ..... *B41J 2/14145* (2013.01); *B41J 2/14032* (2013.01); *B41J 2202/20* (2013.01)

(58) Field of Classification Search
CPC .. B41J 2/1404; B41J 2/14032; B41J 2/14145; B41J 2202/11; B41J 2002/14169; B41J 2202/12; B41J 2202/21; B41J 2202/20
See application file for complete search history.

(56) References Cited

U.S. PATENT DOCUMENTS

| | | | | |
|---|---|---|---|---|
| 10,589,536 | B2 * | 3/2020 | Nakakubo | B41J 2/04581 |
| 11,014,356 | B2 * | 5/2021 | Nakagawa | B41J 2/1404 |
| 2002/0012026 | A1 | 1/2002 | Kubota | |
| 2010/0328403 | A1 | 12/2010 | Xie | |
| 2017/0197422 | A1 | 7/2017 | Moriguchi | |
| 2019/0001671 | A1 * | 1/2019 | Yamada | B41J 2/14145 |

FOREIGN PATENT DOCUMENTS

| | | | |
|---|---|---|---|
| JP | H06-305143 | A | 11/1994 |
| WO | 2018/193446 | A1 | 10/2018 |

* cited by examiner

*Primary Examiner* — An H Do
(74) *Attorney, Agent, or Firm* — Canon U.S.A., Inc. I.P. Division

(57) ABSTRACT

A liquid discharge head includes a substrate, pressure chambers, a pressure generating element, a discharge port, and a liquid channel. First and second communication supply channels and first and second communication collecting channels are formed in the substrate. A central axis of a first communication supply opening is located closer to the corresponding pressure chamber than a central axis of a first common supply opening, or a central axis of a second communication supply opening is located closer to the corresponding pressure chamber than a central axis of a second common supply opening, or a central axis of a first communication collecting opening is located closer to the corresponding pressure chamber than a central axis of a first common collecting opening, or a central axis of a second communication collecting opening is located closer to the corresponding pressure chamber than a central axis of a second common collecting opening.

19 Claims, 17 Drawing Sheets

H=20 μm

H=20 μm

H=33 μm

H=33 μm

LIQUID DISCHARGE HEAD AND LIQUID DISCHARGE MODULE

BACKGROUND OF THE INVENTION

Field of the Invention

The present disclosure relates to a liquid discharge head and a liquid discharge module.

Description of the Related Art

Japanese Patent Laid-Open No. 6-305143 describes a liquid discharge unit. The liquid discharge unit brings a liquid that is a discharge medium and a liquid that is a bubbling medium into contact with each other at an interface and discharges the discharge medium as a result of the growth of a bubble generated in the bubbling medium by application of thermal energy. Japanese Patent Laid-Open No. 6-305143 describes a method of stabilizing the interface between a discharge medium and a bubbling medium within a liquid channel by, after the discharge of the discharge medium, pressurizing the discharge medium and the bubbling medium to form a flow.

SUMMARY OF THE INVENTION

As described in Japanese Patent Laid-Open No. 6-305143, liquids of two types are used and supplied to a channel on a substrate in order to form the flow of two liquids, that is, a discharge medium and a bubbling medium. When two-type liquids are intended to be supplied to channels on a substrate, liquid may need to be supplied from a farther position in a pressure chamber as compared to the case where a single-type liquid is supplied. For this reason, different from the case where one liquid is supplied, the length of the channel tends to increase. If the length of the channel increases, the flow resistance of the channel increases, so liquid supply efficiency decreases.

The present disclosure provides a liquid discharge head capable of suppressing a decrease in liquid supply efficiency while forming the flow of two liquids.

A liquid discharge head includes: a substrate; a plurality of pressure chambers provided on a surface of the substrate and through which a first liquid and a second liquid flow; a pressure generating element provided on the surface of the substrate and configured to pressurize the first liquid; a discharge port communicating with at least any one of the pressure chambers and through which the second liquid is discharged; and a liquid channel communicating with any one of the pressure chambers.

The liquid channel has a first supply channel used to supply the first liquid to a corresponding one of the pressure chambers, a second supply channel used to supply the second liquid to a corresponding one of the pressure chambers, a first collecting channel used to collect the first liquid from a corresponding one of the pressure chambers, and a second collecting channel used to collect the second liquid from a corresponding one of the pressure chambers. In the substrate, a first communication supply channel communicating with the first supply channel via a first communication supply opening and used to supply the first liquid to the first supply channel, a second communication supply channel communicating with the second supply channel via a second communication supply opening and used to supply the second liquid to the second supply channel, a first communication collecting channel communicating with the first collecting channel via a first communication collecting opening and used to collect the first liquid from the first collecting channel, a second communication collecting channel communicating with the second collecting channel via a second communication collecting opening and used to collect the second liquid from the second collecting channel, a first common supply channel communicating with each of a plurality of the first communication supply channels via a first common supply opening and used to supply the first liquid to the plurality of first communication supply channels, a second common supply channel communicating with each of a plurality of the second communication supply channels via a second common supply opening and used to supply the second liquid to the plurality of second communication supply channels, a first common collecting channel communicating with each of a plurality of the first communication collecting channels via a first common collecting opening and used to collect the first liquid from the plurality of first communication collecting channels, and a second common collecting channel communicating with each of a plurality of the second communication collecting channels via a second common collecting opening and used to collect the second liquid from the plurality of second communication collecting channels, are formed. In the substrate, at least any one of a relationship that a central axis of the first communication supply opening is located closer to the corresponding one of the pressure chambers than a central axis of the first common supply opening, a relationship that a central axis of the second communication supply opening is located closer to the corresponding one of the pressure chambers than a central axis of the second common supply opening, a relationship that a central axis of the first communication collecting opening is located closer to the corresponding one of the pressure chambers than a central axis of the first common collecting opening, and a relationship that a central axis of the second communication collecting opening is located closer to the corresponding one of the pressure chambers than a central axis of the second common collecting opening is satisfied.

Further features of the present invention will become apparent from the following description of exemplary embodiments with reference to the attached drawings.

DESCRIPTION OF THE EMBODIMENTS

Configuration of Liquid Discharge Head

Figure 1:
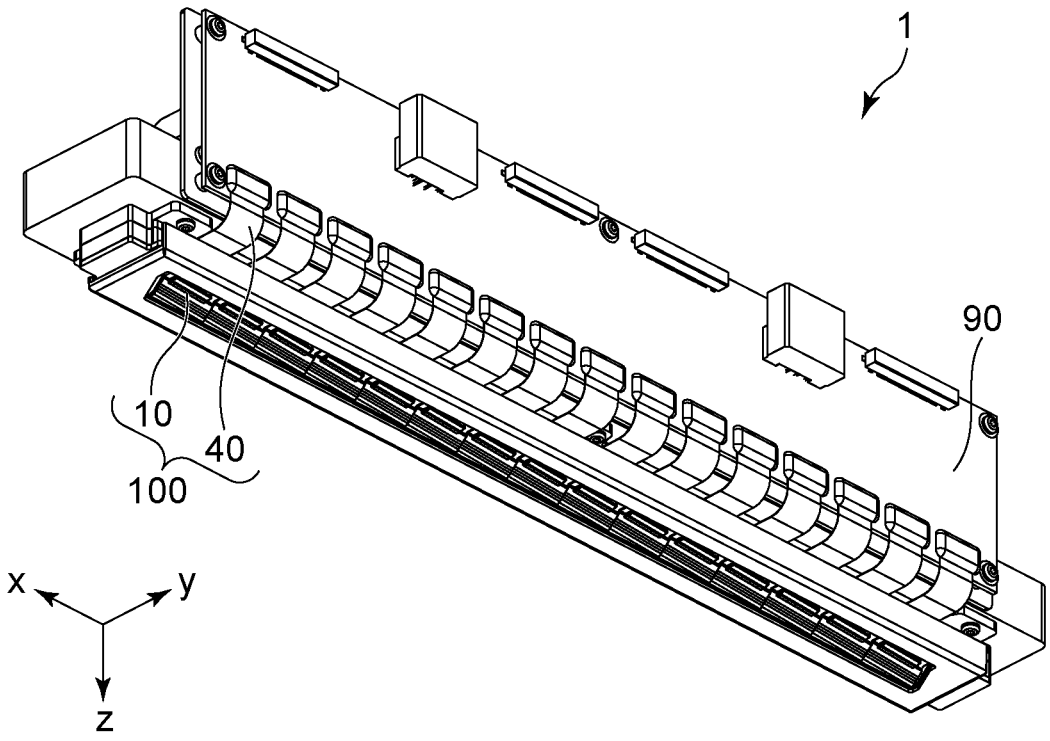
FIG. 1 is a perspective view of a discharge head.

FIG. 1 is a perspective view of a liquid discharge head 1 usable in the present disclosure. The liquid discharge head of an embodiment is configured such that a plurality of liquid discharge modules 100 is arranged in an x direction. Each individual liquid discharge module 100 includes an element substrate 10 in which a plurality of pressure generating elements 12 (see FIG. 4) is arranged, and a flexible printed circuit board 40 used to supply an electric power and a discharge signal to each individual discharge element. Each of the flexible printed circuit boards 40 is connected in common to an electrical wiring board 90 on which electric power supply terminals and discharge signal input terminals are disposed. The liquid discharge module 100 can be simply attached to or detached from the liquid discharge head 1. Thus, any liquid discharge module 100 can be easily attached to or detached from the liquid discharge head 1 without disassembling the liquid discharge head 1.

In this way, for the liquid discharge head 1 made up of the plurality of liquid discharge modules 100 arranged in a longitudinal direction, even when there occurs a discharging failure in any one of the pressure generating elements 12 or other elements, only the liquid discharge module 100 in which a failure has occurred is replaced. Thus, yields in a manufacturing process for the liquid discharge head 1 are improved, and cost at the time of head replacement is reduced.

Configuration of Liquid Discharge Apparatus

Figure 2:
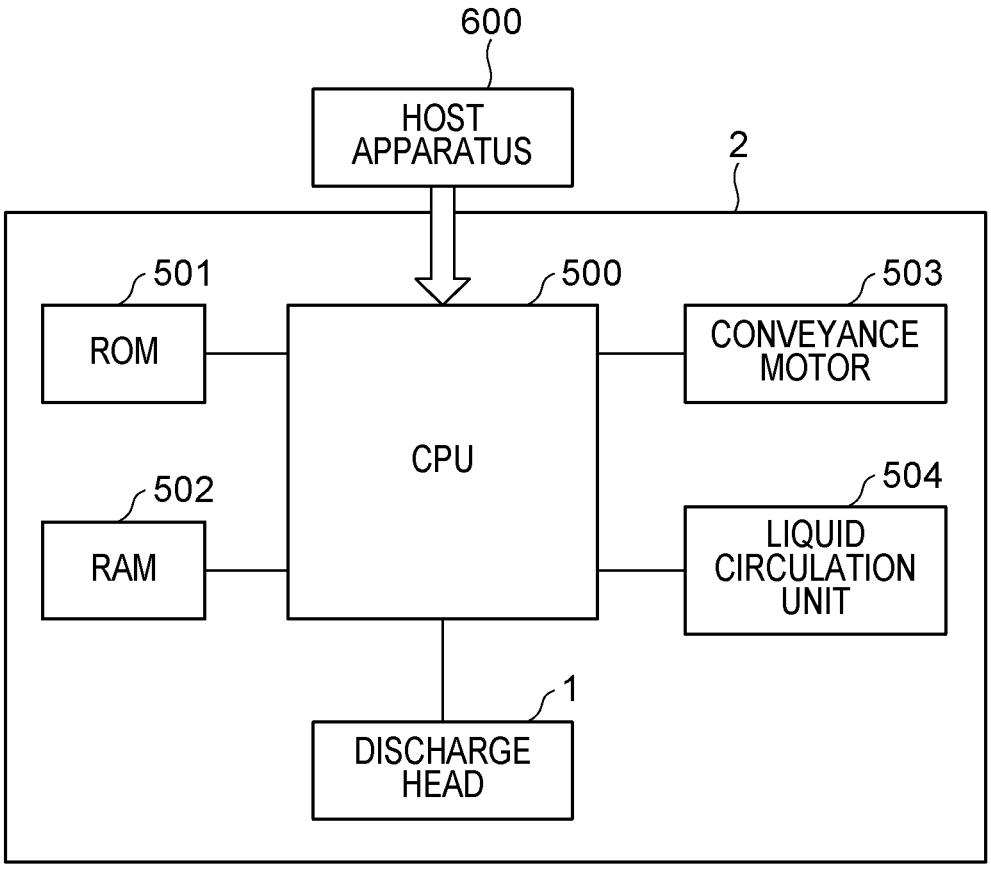
FIG. 2 is a block diagram for illustrating a control configuration of a liquid discharge apparatus.

FIG. 2 is a block diagram showing a control configuration of a liquid discharge apparatus 2 usable in the present disclosure. A CPU 500 controls the overall liquid discharge apparatus 2 while using RAM 502 as a work area in accordance with programs stored in ROM 501. The CPU 500, for example, performs predetermined data processing on discharge data received from an externally connected host apparatus 600 in accordance with programs and parameters stored in the ROM 501, and generates a discharge signal based on which the liquid discharge head 1 is able to perform discharging. The CPU 500 conveys a liquid apply target medium in a predetermined direction by driving a conveyance motor 503 while driving the liquid discharge head 1 in accordance with the discharge signal, thus applying liquid discharged from the liquid discharge head 1 to the apply target medium.

A liquid circulation unit 504 is a unit for controlling the flow of liquid in the liquid discharge head 1 by supplying liquid to the liquid discharge head 1 while circulating the liquid. The liquid circulation unit 504 includes a sub tank that stores liquid, a channel that circulates liquid between the sub tank and the liquid discharge head 1, a plurality of pumps, a flow regulating unit for adjusting the flow rate of liquid flowing inside the liquid discharge head 1, and the like. Under an instruction from the CPU 500, the liquid circulation unit 504 controls the above-described mechanisms such that liquid flows at a predetermined flow rate in the liquid discharge head 1.

Configuration of Element Substrate

Figure 3:
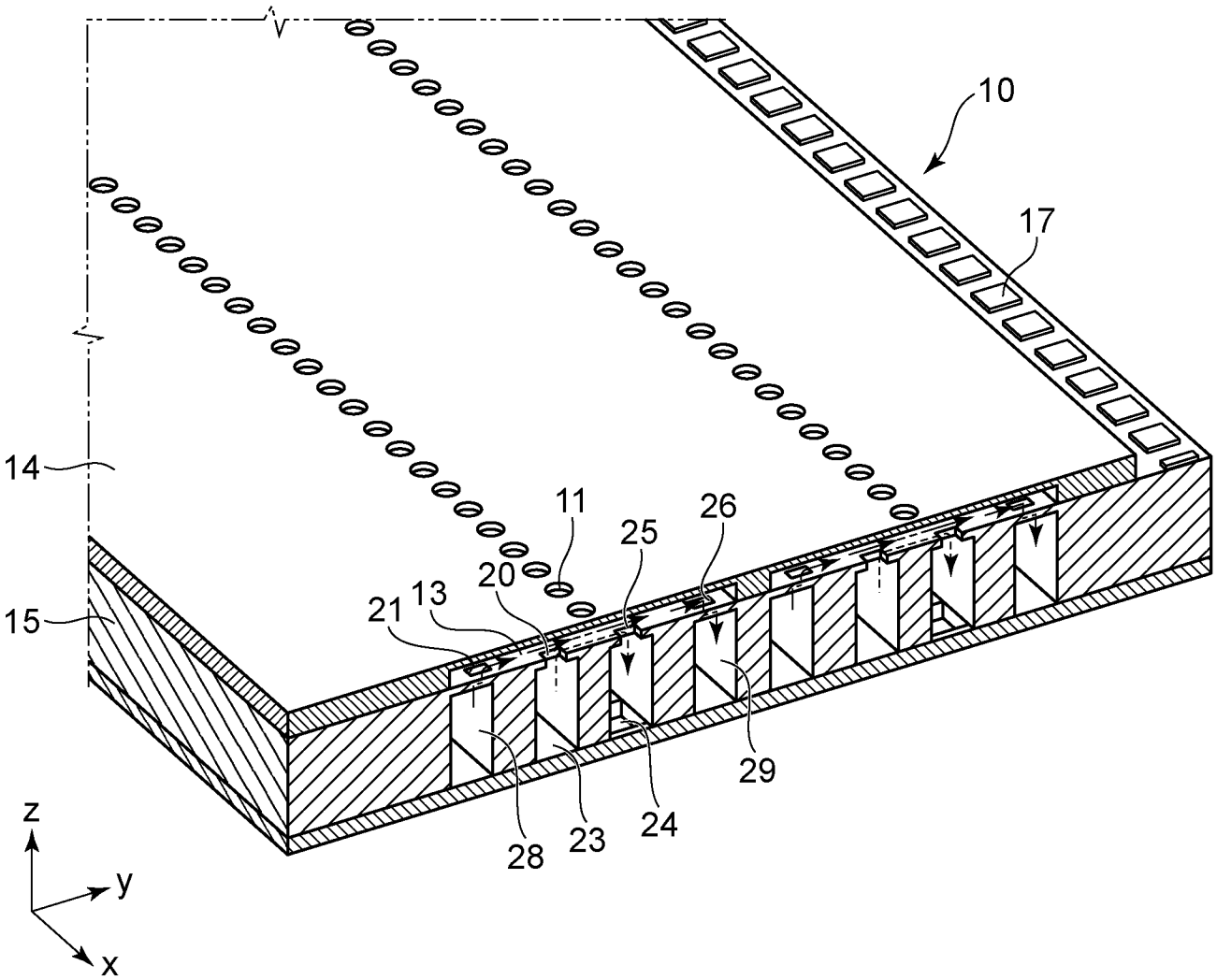
FIG. 3 is a cross-sectional perspective view of an element substrate in a liquid discharge module.

FIG. 3 is a cross-sectional perspective view of the element substrate 10 provided in each individual liquid discharge module 100. The element substrate 10 is made such that an orifice plate 14 (discharge port forming member) is laminated on a silicon (Si) substrate 15. In FIG. 3, discharge ports 11 arranged in the x direction discharge a liquid of the same type (for example, a liquid supplied from a common sub tank or supply port). Here, an example in which the orifice plate 14 also has liquid channels 13 is shown. Alternatively, the liquid channels 13 may be formed by another member (channel wall member), and the orifice plate 14 having the discharge ports 11 may be provided on the channel wall member.

The pressure generating elements 12 (not shown in FIG. 3) are respectively disposed at positions corresponding to the individual discharge ports 11 on the silicon substrate (hereinafter, simply referred to as substrate) 15. The discharge ports 11 and the pressure generating elements 12 are provided at facing positions. When a voltage is applied according to a discharge signal, the pressure generating element 12 pressurizes liquid in a z direction intersecting with a flow direction (y direction), and the liquid is discharged as a liquid droplet through the discharge port 11 facing the pressure generating element 12. An electric power and a drive signal for the pressure generating element 12 are supplied from the flexible printed circuit board 40 (see FIG. 1) via a terminal 17 disposed on the substrate 15.

A plurality of the liquid channels 13 is formed in the orifice plate 14. Each of the liquid channels 13 extends in the y direction and individually connects with a corresponding one of the discharge ports 11. More specifically, the plurality of liquid channels 13 arranged in the x direction each communicates with a plurality of communication channels (described later). The plurality of communication channels each communicates with a first common supply channel 23, a first common collecting channel 24, a second common supply channel 28, and a second common collecting channel 29. Hereinafter, the first common supply channel 23, the first common collecting channel 24, the second common supply channel 28, and the second common collecting channel 29 are simply referred to as common channels when collectively referred. The flow of liquid in the first common supply channel 23, the first common collecting channel 24, the second common supply channel 28, and the second common collecting channel 29 is controlled by the liquid circulation unit 504 described with reference to FIG. 2. Specifically, a first liquid flowing from the first common supply channel 23 into each liquid channel 13 is controlled to flow toward the first common collecting channel 24, and a second liquid flowing from the second common supply channel 28 into each liquid channel 13 is controlled to flow toward the second common collecting channel 29. The first common supply channel 23, the first common collecting channel 24, the second common supply channel 28, and the second common collecting channel 29 are connected to the plurality of liquid channels 13 arranged in the x direction.

FIG. 3 shows an example in which two sets of the thus configured discharge ports 11 and the liquid channels 13 arranged in the x direction are arranged in the y direction. FIG. 3 shows a configuration in which the discharge ports 11 are disposed at positions facing the pressure generating elements 12, that is, in a bubble growth direction; however, the present embodiment is not limited thereto. Discharge ports may be provided at, for example, positions orthogonal to a bubble growth direction.

Configuration of Liquid Channel and Pressure Chamber

Figure 4A:
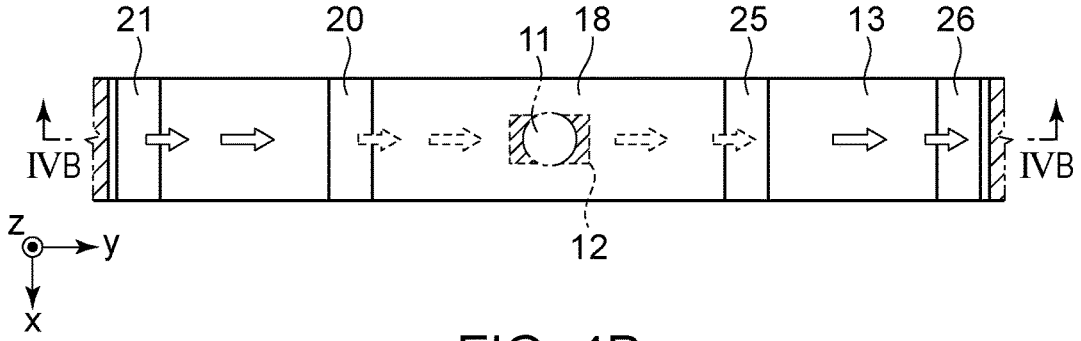
FIG. 4A to FIG. 4D are enlarged detail views of a liquid channel and a pressure chamber in a first embodiment.
Figure 4B:
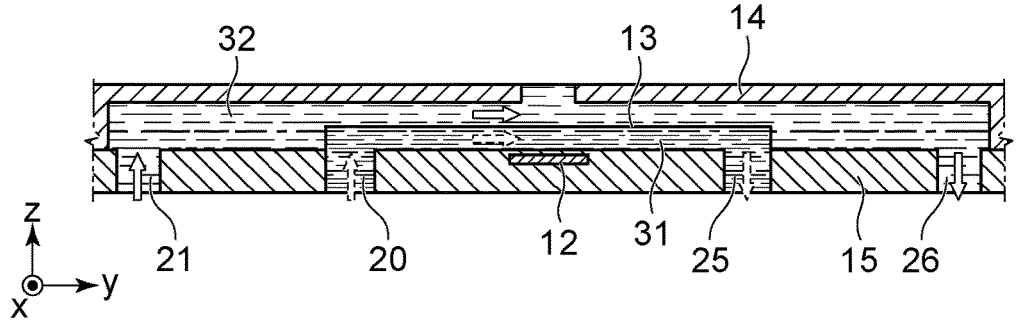
Figure 4C:
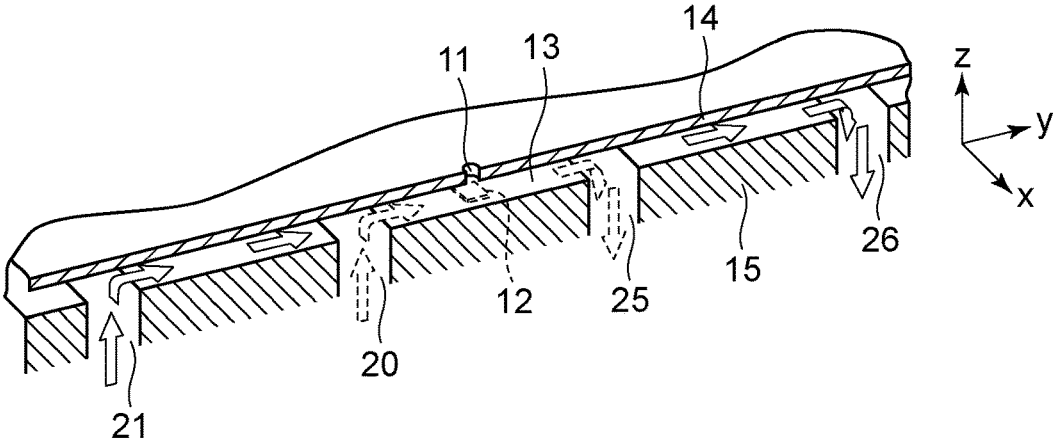
Figure 4D:
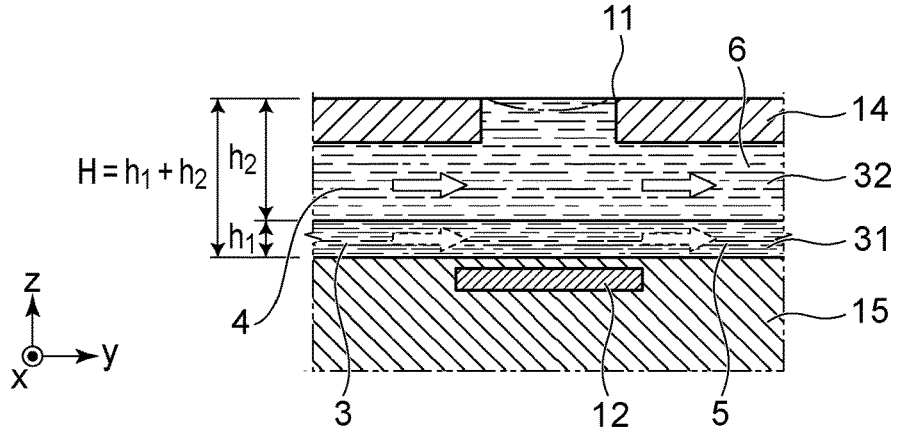

FIG. 4A to FIG. 4D are views for illustrating the detailed configuration of one pair of the liquid channel 13 and the pressure chamber 18, formed on the surface of the substrate 15. FIG. 4A is a see-through view from the discharge port 11 side (+z side). FIG. 4B is a cross-sectional view taken along the line IVB-IVB in FIG. 4A. FIG. 4C is an enlarged view around the one liquid channel 13 in the element substrate 10 shown in FIG. 3. FIG. 4D is an enlarged view around the discharge port 11 in FIG. 4B.

A second communication supply channel 21, a first communication supply channel 20, a first communication collecting channel 25, and a second communication collecting channel 26 are formed in the substrate corresponding to the bottom portion of the liquid channel 13 in this order in the y direction. The pressure chamber 18 that communicates with the discharge port 11 and that contains the pressure generating element 12 is disposed substantially in the middle between the first communication supply channel 20 and the first communication collecting channel 25 in the liquid channel 13. Here, the pressure chamber 18 is a space that contains the pressure generating element 12 inside and that stores liquid to which a pressure generated by the pressure generating element 12 is applied. Or, the pressure chamber 18 is a space inside a circle with a radius a about the pressure generating element 12 where the length from the pressure generating element 12 to the discharge port 11 is defined as a. The second communication supply channel 21 connects with the second common supply channel 28, the first communication supply channel 20 connects with the first common supply channel 23, the first communication collecting channel 25 connects with the first common collecting channel 24, and the second communication collecting channel 26 connects with the second common collecting channel 29 (see FIG. 3). Hereinafter, the first communication supply channel 20, the second communication supply channel 21, the first communication collecting channel 25, and the second communication collecting channel 26 are simply referred to as communication channels when collectively referred.

Based on the above configuration, a first liquid 31 supplied from the first common supply channel 23 to the liquid channel 13 via the first communication supply channel 20 flows in the y direction (direction indicated by the arrow), passes through the pressure chamber 18, and is then collected by the first common collecting channel 24 via the first communication collecting channel 25. Also, a second liquid 32 supplied from the second common supply channel 28 to the liquid channel 13 via the second communication supply channel 21 flows in the y direction (direction indicated by the arrow), passes through the pressure chamber 18, and is then collected by the second common collecting channel 29 via the second communication collecting channel 26. In other words, both the first liquid 31 and the second liquid 32 flow in the y direction between the first communication supply channel 20 and the first communication collecting channel 25 within the liquid channel 13.

In the pressure chamber 18, the pressure generating element 12 is in contact with the first liquid 31, and the second liquid 32 exposed to the atmosphere forms a meniscus near the discharge port 11. In the pressure chamber 18, the first liquid 31 and the second liquid 32 flow such that the pressure generating element 12, the first liquid 31, the second liquid 32, and the discharge port 11 are arranged in this order. In other words, where a side on which the pressure generating element 12 is present is a lower side and a side on which the discharge port 11 is present is an upper side, the second liquid 32 flows on the upper side of the first liquid 31. The first liquid 31 and the second liquid 32 are pressurized by the pressure generating element 12 on the lower side and is discharged from the lower side toward the upper side. This upper and lower direction is the height direction of each of the pressure chamber 18 and the liquid channel 13.

In the present embodiment, the flow rate of the first liquid 31 and the flow rate of the second liquid 32 are adjusted according to the physical properties of the first liquid 31 and the physical properties of the second liquid 32 such that the first liquid 31 and the second liquid 32 flow alongside while being in contact with each other in the pressure chamber 18 as shown in FIG. 4D. In the first embodiment and the second embodiment, the first liquid and the second liquid are caused to flow in the same direction; however, the present disclosure is not limited thereto. In other words, the second liquid may flow in a direction opposite to a flow direction of the first liquid. Alternatively, channels may be provided such that the flow of the first liquid 31 and the flow of the second liquid 32 are orthogonal to each other. The liquid discharge head 1 is configured such that the second liquid 32 flows on the upper side of the first liquid 31 in the height direction of the liquid channel (pressure chamber); however, the present disclosure is not limited thereto. The first liquid and the second liquid each may flow in contact with the bottom face of the liquid channel (pressure chamber).

Such a flow of two liquids includes not only a parallel flow in which two liquids flow in the same direction as shown in FIG. 4D but also a counter flow in which a second liquid flows in a direction opposite to a flow direction of a first liquid or a flow of liquids in which the flow of a first liquid and the flow of a second liquid intersect with each other. Hereinafter, of these, parallel flows will be described as an example.

In the case of a parallel flow, it is desirable that the interface between the first liquid 31 and the second liquid 32 be not disrupted, that is, a flow in the pressure chamber 18 through which the first liquid 31 and the second liquid 32 flow be in a laminar flow state. Particularly, when discharge performance is intended to be controlled, for example, a predetermined discharge amount is maintained, it is desirable to drive the pressure generating element 12 in a state where the interface is stable. However, the present disclosure is not limited thereto. Even when a flow in the pressure chamber 18 is a turbulent flow and, as a result, the interface between two liquids is somewhat disrupted, at least the pressure generating element 12 may be driven as long as the first liquid flows mainly on the pressure generating element 12 side and the second liquid flows mainly on the discharge port 11 side. Hereinafter, an example in which a flow in the pressure chamber is a parallel flow in a laminar flow state will be mainly described.

Forming Condition for Laminar Parallel Flow

Initially, a condition under which liquids form a laminar flow in a pipe will be described. Generally, Reynolds number Re indicating the ratio of interfacial tension to viscous force is known as an index for assessment of a flow.

Where the density of a liquid is ρ, the flow velocity is u, the characteristic length is d, and the viscosity is η, a Reynolds number Re is expressed by the formula 1.

$$Re=\rho ud/\eta \quad (1)$$

Here, it is known that a laminar flow is more likely to be formed as the Reynolds number Re reduces. Specifically, it is known that, for example, a flow in a circular pipe is a laminar flow when the Reynolds number Re is lower than about 2200 and a flow in a circular pipe is a turbulent flow when the Reynolds number Re is higher than about 2200.

The fact that a flow is a laminar flow means that a flow line is parallel to a travel direction of a flow and does not intersect with the travel direction. Therefore, when two liquids that are in contact with each other each are a laminar flow, a parallel flow in which the interface between the two liquids is stable is formed. Here, considering a general inkjet printing head, a flow channel height (pressure chamber height) H [μm] around a discharge port in a liquid channel (pressure chamber) is about 10 μm to about 100 μm. Thus, when water (density $\rho=1.0\times10^3$ kg/m$^3$, viscosity $\eta=1.0$ cP) is caused to flow through the liquid channel of the inkjet printing head at a flow velocity of 100 mm/s, the Reynolds number $Re=\rho ud/\eta\approx0.1$ to $1.0<<2200$, so it may be regarded that a laminar flow is formed.

As shown in FIG. 4A to FIG. 4D, even when the cross section of the liquid channel 13 or the pressure chamber 18 is rectangular, the liquid channel 13 or the pressure chamber 18 may be regarded equivalently to those of a circular pipe, that is, the effective diameter of the liquid channel 13 or the pressure chamber 18 may be regarded as the diameter of a circular pipe.

Theoretical Forming Condition for Laminar Parallel Flow

Next, a condition for forming a parallel flow in which the interface between liquids of two types is stable in the liquid channel 13 and the pressure chamber 18 will be described with reference to FIG. 4D. Initially, a distance from the substrate 15 to the discharge port surface of the orifice plate 14 is defined as H [μm]. A distance from the discharge port surface to the liquid-to-liquid interface between the first liquid 31 and the second liquid 32 (the phase thickness of the second liquid) is defined as $h_2$ [μm]. A distance from the liquid-to-liquid interface to the substrate 15 (the phase thickness of the first liquid) is defined as $h_1$ [μm]. In other words, $H=h_1+h_2$.

Here, the velocity of liquid on the walls of the liquid channel 13 and pressure chamber 18 is zero as a boundary condition in the liquid channel 13 and the pressure chamber 18. It is also assumed that the velocity and shearing stress at the liquid-to-liquid interface between the first liquid 31 and the second liquid 32 have continuity. On this assumption, when it is assumed that the first liquid 31 and the second liquid 32 form two-layer parallel steady flows, the quartic equation shown in the equation 2 holds in a parallel flow section.

$$(\eta_1-\eta_2)(\eta_1Q_1+\eta_2Q_2)h_1^4+2\eta_1H\{\eta_2(3Q_1+Q_2)-2\eta_1Q_1\}h_1^3+3\eta_1H^2\{2\eta_1Q_1-\eta_2(3Q_1+Q_2)\}h_1^2+4\eta_1Q_1H^3)\eta_2-\eta_1)h_1+\eta_1^2Q_1H^4=0 \quad (2)$$

In the equation 2, $\eta_1$ denotes the viscosity of the first liquid 31, $\eta_2$ denotes the viscosity of the second liquid 32, $Q_1$ denotes the flow rate of the first liquid 31, and $Q_2$ denotes the flow rate of the second liquid 32. In other words, within the range in which the quartic equation 2 holds, the first liquid and the second liquid flow so as to achieve a positional relationship according to their flow rates and viscosities, and a parallel flow with a stable interface is formed. In the present embodiment, it is desirable that a parallel flow of the first liquid and the second liquid be formed in the liquid channel 13, and at least in the pressure chamber 18. When such a parallel flow is formed, the first liquid and the second liquid just mix through molecular diffusion at their liquid-to-liquid interface and flow parallel in the y direction without substantially mixing with each other. In the present embodiment, the flow of liquids in part of a region in the pressure chamber 18 does not need to be in a laminar flow state. It is desirable that the flow of liquids flowing through at least a region on the pressure generating element 12 be in a laminar flow state.

Even when, for example, immiscible solvents like water and oil are used as a first liquid and a second liquid, but when the equation 2 is satisfied, a parallel flow is formed regardless of the fact that both are immiscible. Even in the case of water and oil, it is desirable that, even when a flow in the pressure chamber is somewhat in a turbulent flow state and the interface is disrupted as described above, at least mostly the first liquid flow on the pressure generating element and mostly the second liquid flow through the discharge port.

Figure 5A:
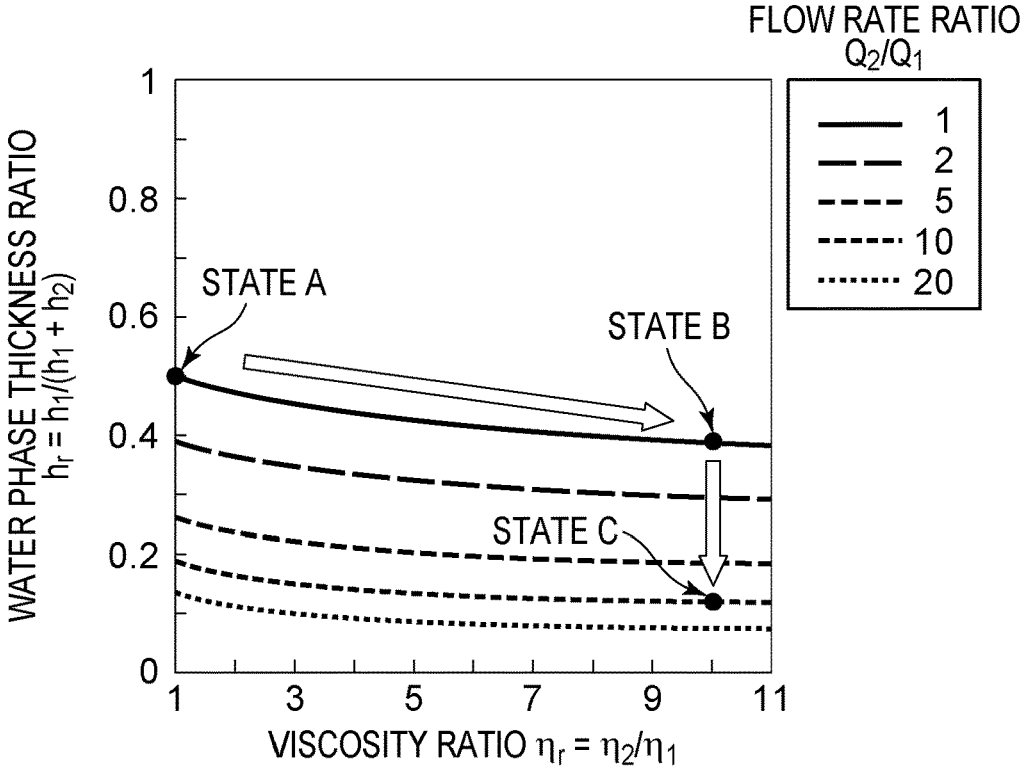
FIG. 5A is a graph showing the relationship between viscosity ratio and water phase thickness ratio.

FIG. 5A is a graph showing the case where the relationship between viscosity ratio $\eta_r=\eta_2/\eta_1$ and the phase thickness ratio $h_r=h_1/(h_1+h_2)$ of the first liquid for multiple different flow rate ratios $Q_r=Q_2/Q_1$. The first liquid is not limited to water, and, hereinafter, the "phase thickness ratio of the first liquid" is referred to as "water phase thickness ratio". The abscissa axis represents viscosity ratio $\eta_r=\eta_2/\eta_1$, and the ordinate axis represents water phase thickness ratio $h_r=h_1/(h_1+h_2)$. As the flow rate ratio $Q_r$ increases, the water phase thickness ratio $h_r$ reduces. For any flow rate ratio $Q_r$ as well, as the viscosity ratio $\eta_r$ increases, the water phase thickness ratio $h_r$ reduces. In other words, the water phase thickness ratio $h_r$ (the interface position between the first liquid and the second liquid) in the liquid channel 13 (pressure chamber) can be adjusted to a predetermined value by controlling the viscosity ratio $\eta_r$ and the flow rate ratio $Q_r$ between the first liquid and the second liquid. Then, according to FIG. 5A, it is found that, when the viscosity ratio $\eta_r$ and the flow rate ratio $Q_r$ are compared with each other, the flow rate ratio $Q_r$ more influences on the water phase thickness ratio $h_r$ than the viscosity ratio $\eta_r$.

For the water phase thickness ratio $h_r=h_1/(h_1+h_2)$, when $0<h_r<1$ (Condition 1) is satisfied, a parallel flow of the first liquid and the second liquid is formed in the liquid channel (pressure chamber). However, as will be described later, in the present embodiment, the first liquid is mainly caused to function as a bubbling medium and the second liquid is mainly caused to function as a discharge medium, and the first liquid and the second liquid included in discharge liquid droplets are stabilized at a desired ratio. When such a situation is considered, the water phase thickness ratio $h_r$ is preferably lower than or equal to 0.8 (Condition 2) and is more preferably lower than or equal to 0.5 (Condition 3).

Here, the state A, the state B, and the state C, shown in FIG. 5A, respectively indicate the following states.

Figure 5B:
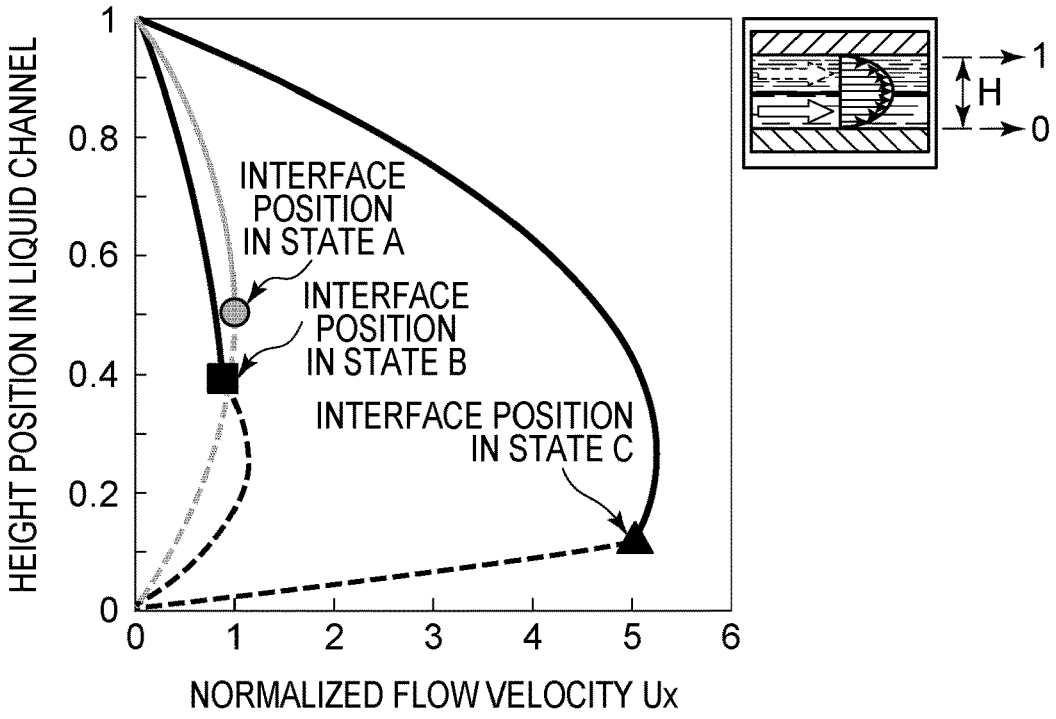
FIG. 5B is a graph showing the relationship between the height of the pressure chamber and flow velocity.

State A) Water phase thickness ratio $h_r=0.50$ in the case where viscosity ratio $\eta_r=1$ and flow rate ratio $Q_r=1$ State B) Water phase thickness ratio $h_r=0.39$ in the case where viscosity ratio $\eta_r=10$ and flow rate ratio $Q_r=1$ State C) Water phase thickness ratio $h_r=0.12$ in the case where viscosity ratio $\eta_r=10$ and flow rate ratio $Q_r=10$ FIG. 5B is a graph showing a flow velocity distribution in the height direction (z direction) of the liquid channel 13 (pressure chamber) for each of the states A, B, and C. The abscissa axis represents normalized value Ux obtained through normalization where a flow velocity maximum value in the state A is 1 (reference). The ordinate axis represents height from a bottom face where the height H of the liquid channel 13 (pressure chamber) is 1 (reference). In curves representing the states, the interface positions between the first liquid and the second liquid are indicated by markers. It is found that the interface position changes with the state, for example, the interface position of the state A is higher than the interface position of the state B or the state C. This is because, when liquids of two types having different viscosities each are a laminar flow (laminar flow as a whole) and flow parallel in a pipe, the interface between these two liquids is formed at a position where a pressure difference due to the difference in viscosity between these liquids and a Laplace pressure due to interfacial tension balance out.

Relationship Between Flow Rate Ratio and Water Phase Thickness Ratio

Figure 6:
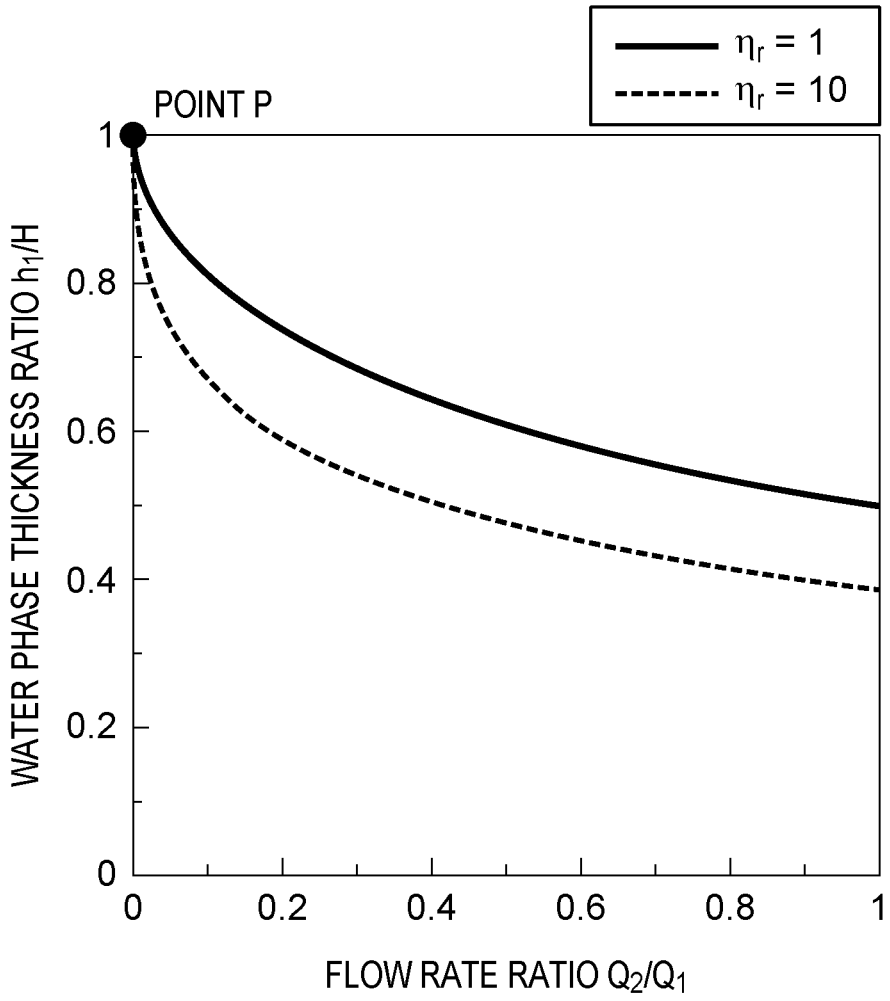
FIG. 6 is a graph showing the relationship between flow rate ratio and water phase thickness ratio.

FIG. 6 is a graph showing the relationship between flow rate ratio $Q_r$ and water phase thickness ratio $h_r$ for the case where the viscosity ratio $\eta_r=1$ and the case where the viscosity ratio $\eta_r=10$ by using the equation 2. The abscissa axis represents flow rate ratio $Q_r=Q_2/Q_1$, and the ordinate axis represents water phase thickness ratio $h_r=h_1/(h_1+h_2)$. The flow rate ratio $Q_r=0$ corresponds to the case where $Q_2=0$, the liquid channel is filled with only the first liquid, no second liquid is present, and the water phase thickness ratio $h_r=1$. The point P in the graph indicates this state.

As $Q_r$ is increased from the position of the point P (that is, the flow rate $Q_2$ of the second liquid is increased from zero), the water phase thickness ratio $h_r$, that is, the water phase thickness $h_1$ of the first liquid, reduces, and the water phase thickness $h_2$ of the second liquid increases. In other words, the state shifts from the state where only the first liquid flows to the state where the first liquid and the second liquid flow parallel via the interface. Such a tendency is similarly ensured not only in the case where the viscosity ratio between the first liquid and the second liquid is $\eta_r=1$ but also in the case where the viscosity ratio $\eta_r=10$.

In other words, to achieve a state where the first liquid and the second liquid flow alongside via the interface in the liquid channel 13, $Q_r=Q_2/Q_1>0$, that is, $Q_1>0$ and $Q_2>0$, need to be satisfied. This means that the first liquid and the second liquid both flow in the same y direction.

Transient State of Discharge Operation

Next, a transient state of discharge operation in the liquid channel 13 and the pressure chamber 18, in which a parallel flow is formed, will be described. FIG. 7A to FIG. 7E are diagrams schematically showing a transient state in the case where discharge operation is performed in a state where the first liquid and the second liquid at the viscosity ratio $\eta_r=4$ form a parallel flow. In FIG. 7A to FIG. 7E, the height H of the liquid channel 13 (pressure chamber) is H [μm]=20 μm, and the thickness T of the orifice plate 14 is T [μm]=6 μm.

Figure 7A:
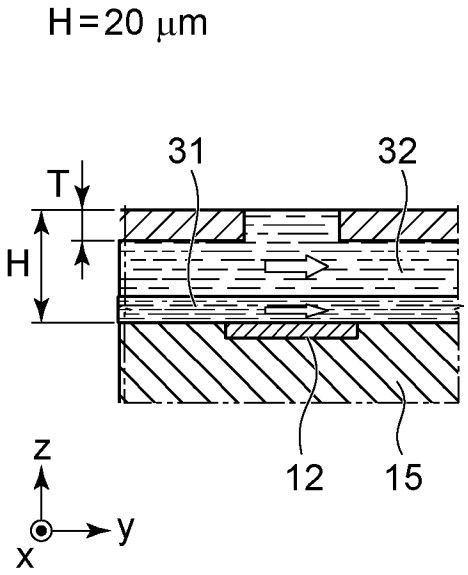
FIG. 7A to FIG. 7E are diagrams schematically showing a transient state of discharge operation.

FIG. 7A shows a state before a voltage is applied to the pressure generating element 12. Here, FIG. 7A shows a state where the interface position is stabilized at a position where the water phase thickness ratio $\eta_r=0.57$ (that is, the water phase thickness $h_1$ [μm] of the first liquid=6 μm) by adjusting $Q_1$ and $Q_2$ of the first liquid and second liquid flowing together.

Figure 7B:
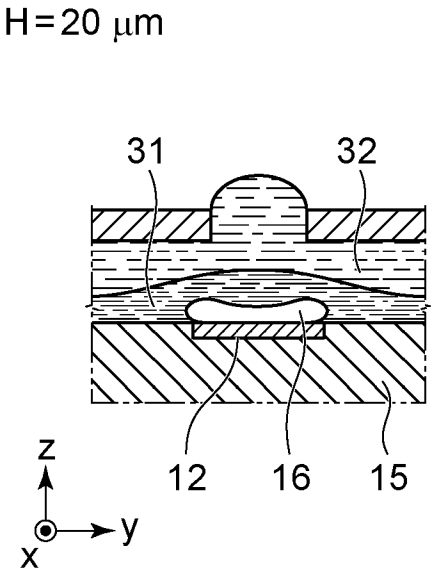

FIG. 7B shows a state where a voltage begins to be applied to the pressure generating element 12. The pressure generating element 12 of the present embodiment is an electrothermal converter (heater). In other words, the pressure generating element 12 rapidly generates heat when applied with a voltage pulse according to a discharge signal to cause film boiling to occur in the first liquid with which the pressure generating element 12 contacts. In the diagram, a state where a bubble 16 is generated by film boiling is shown. By the amount by which the bubble 16 is generated, the interface between the first liquid 31 and the second liquid 32 moves in the z direction (the height direction of the pressure chamber), and the second liquid 32 is pushed out in the z direction beyond the discharge port 11.

Figure 7C:
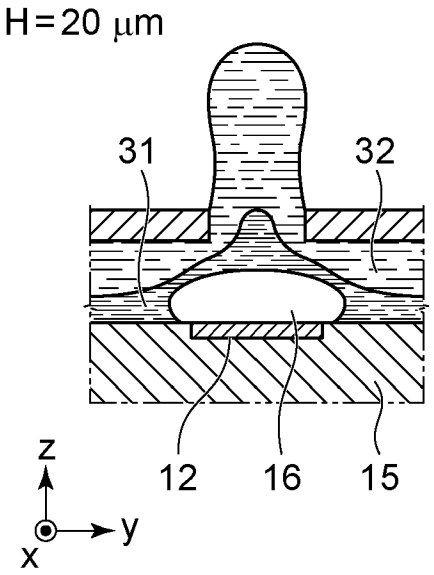

FIG. 7C shows a state where the volume of the bubble 16 generated by film boiling has increased and the second liquid 32 is further pushed out in the z direction beyond the discharge port 11.

Figure 7E:
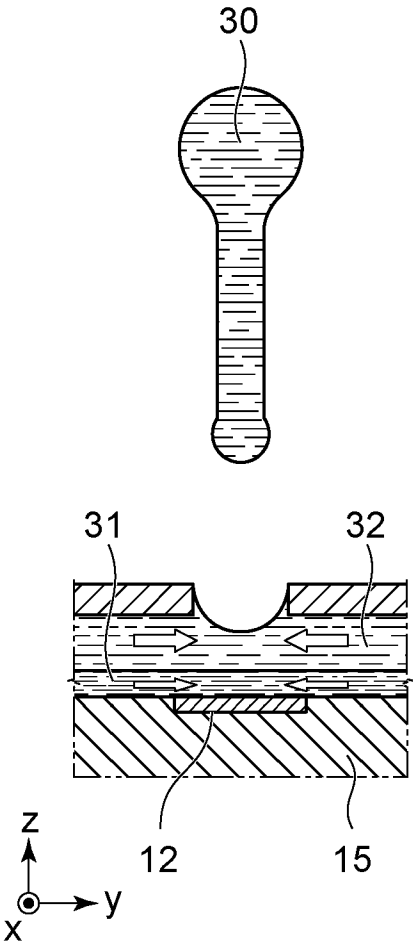
Figure 7D:
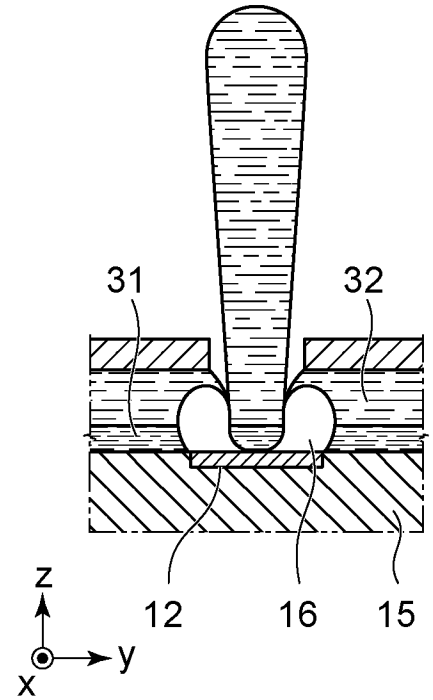
Figure 8A:
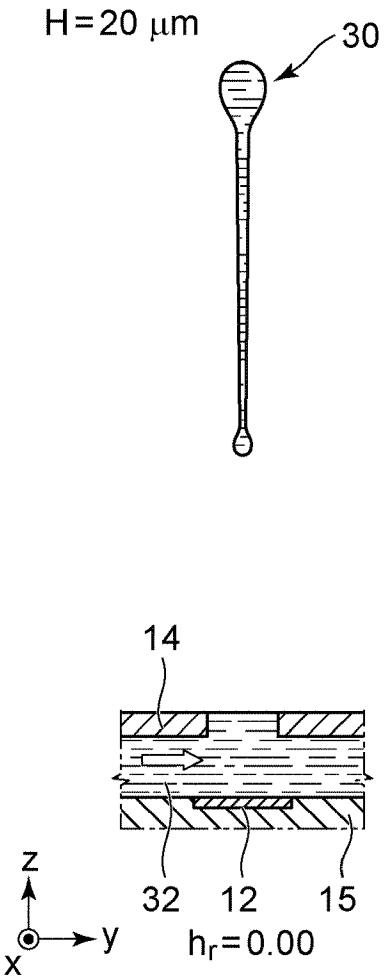
FIG. 8A to FIG. 8G are diagrams showing discharge liquid droplets for various water phase thickness ratios.
Figure 8B:
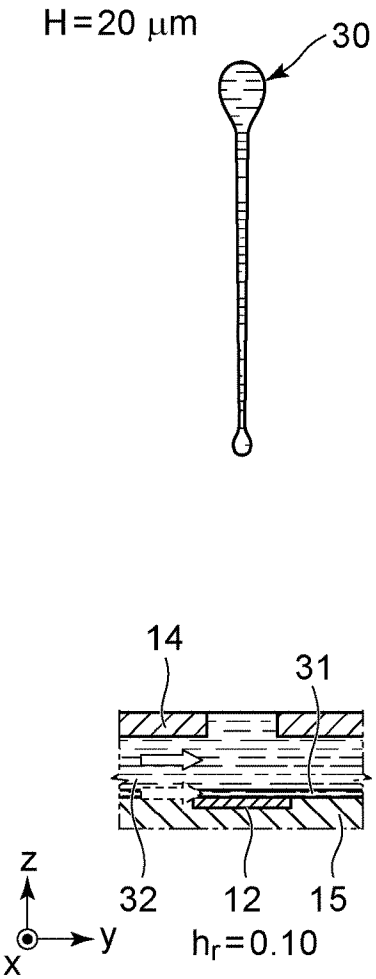
Figure 8C:
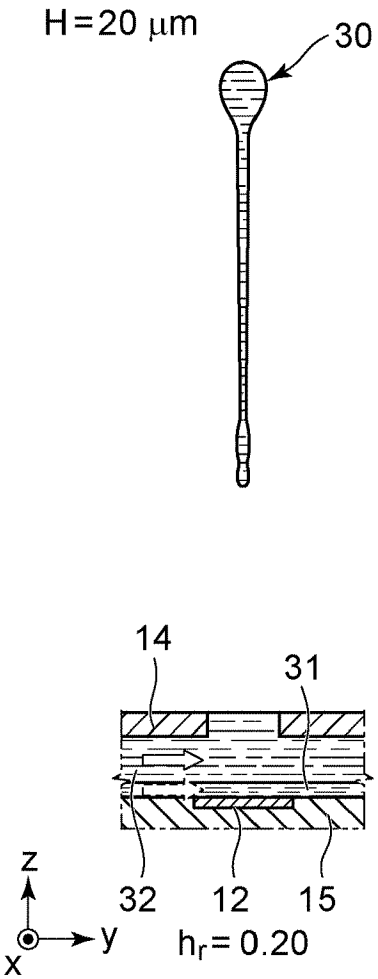
Figure 8D:
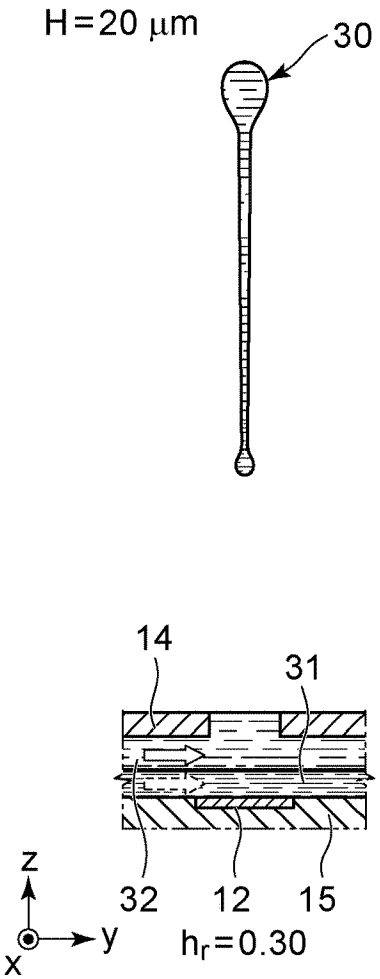
Figure 8E:
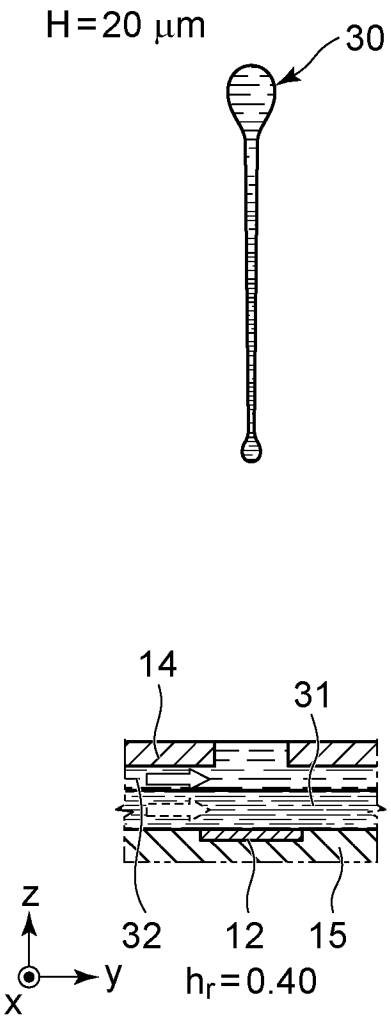
Figure 8F:
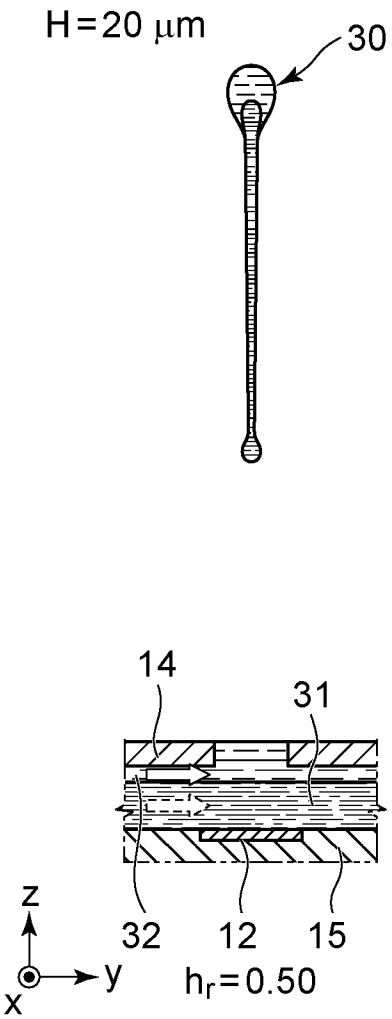
Figure 8G:
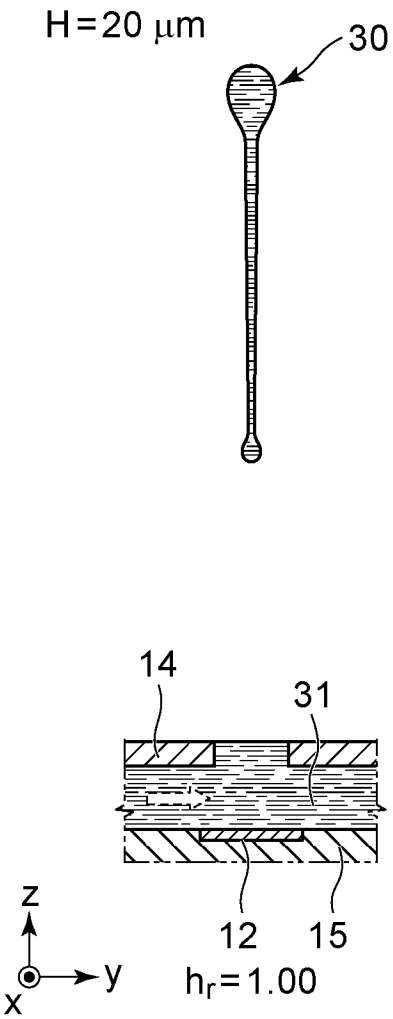
Figure 9A:
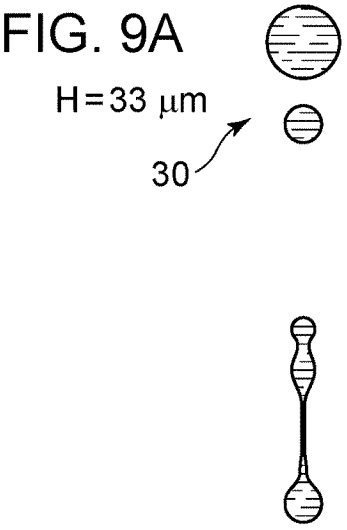
FIG. 9A to FIG. 9E are diagrams showing discharge liquid droplets for various water phase thickness ratios.
Figure 9A:
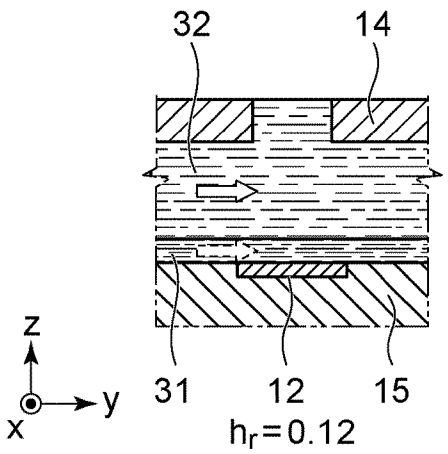
Figure 9B:
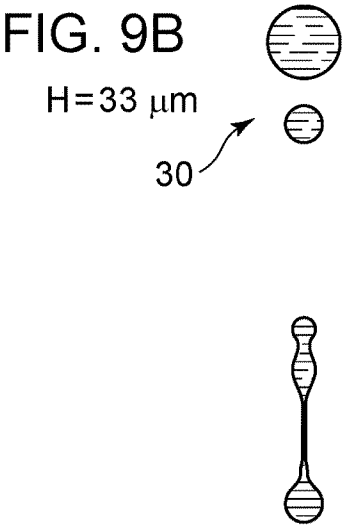
Figure 9B:
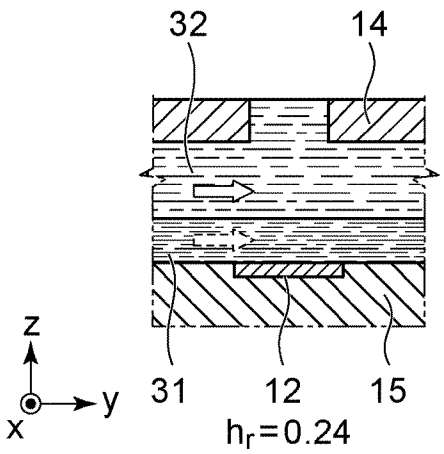
Figure 9C:
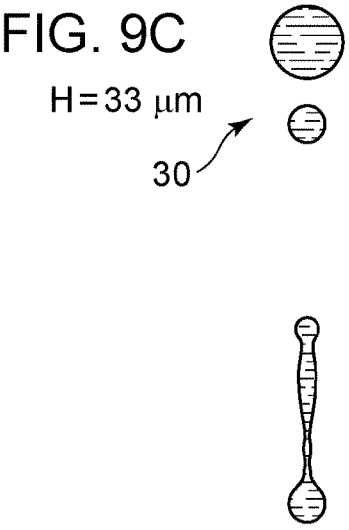
Figure 9C:
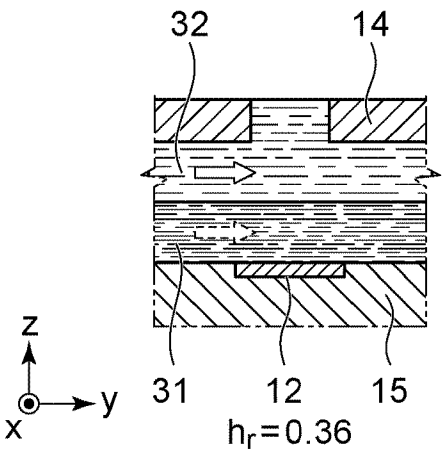
Figure 9D:
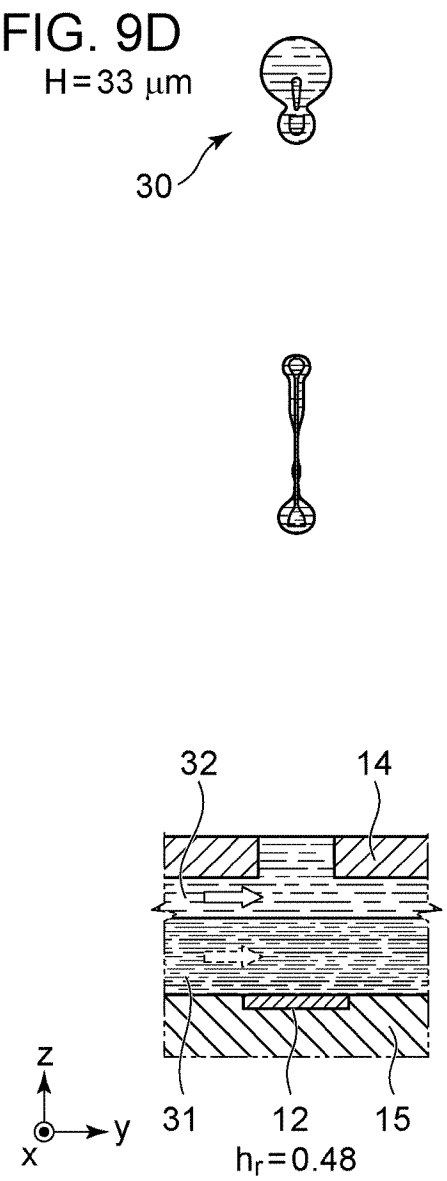
Figure 9E:
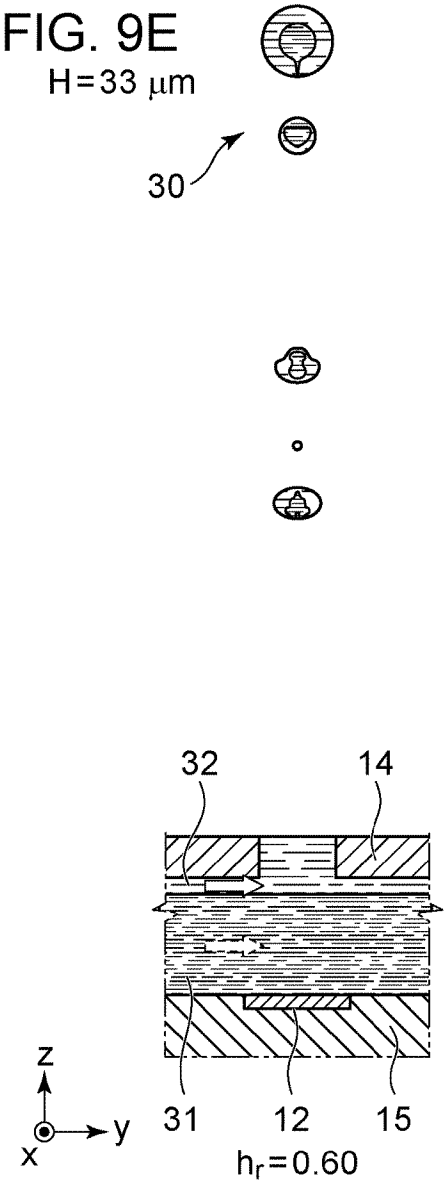

FIG. 7D shows a state where the bubble 16 communicates with the atmosphere. In the present embodiment, at the shrinkage stage after the maximum growth of the bubble 16, a gas-liquid interface moved from the discharge port 11 to the pressure generating element 12 side communicates with the bubble 16.

FIG. 7E shows a state where a liquid droplet 30 has been discharged. A liquid already projected beyond the discharge port 11 at the timing when the bubble 16 communicates with the atmosphere as shown in FIG. 7D leaves from the liquid channel 13 under the inertial force and ejects in the z direction in form of the liquid droplet 30. On the other hand, in the liquid channel 13, the amount of liquid consumed as a result of the discharge is supplied from both sides of the discharge port 11 by the capillary force of the liquid channel 13, and a meniscus is formed again in the discharge port 11. A parallel flow of the first liquid and the second liquid flowing in the y direction is formed again as shown in FIG. 7A.

In this way, in the present embodiment, discharge operation shown in FIG. 7A to FIG. 7E is performed in a state where the first liquid and the second liquid are flowing as a parallel flow. When description will be specifically made again with reference to FIG. 2, the CPU 500 uses the liquid circulation unit 504 to circulate the first liquid and the second liquid in the discharge head 1 while maintaining the constant flow rate of the first liquid and the constant flow rate of the second liquid. While the CPU 500 continues such control, the CPU 500 applies voltages in accordance with discharge data to the individual pressure generating elements 12 disposed in the discharge head 1. Depending on the amount of liquid discharged, the flow rate of the first liquid and the flow rate of the second liquid may be not always constant.

When discharge operation is performed in a state where liquids are flowing, there may be concerns that the flow of the liquids influences discharge performance. However, in a general inkjet printing head, the liquid droplet discharge velocity by orders of several meters per second to several tens of meters per second and by far higher than the flow velocity in the liquid channel by orders of several millimeters per second to several meters per second. Thus, even when discharge operation is performed in a state where the first liquid and the second liquid flow at several millimeters per second to several meters per second, discharge performance is less likely to come under the influence of such discharge operation.

In the present embodiment, the configuration in which the bubble 16 and the atmosphere communicate in the pressure chamber 18 is described; however, the present disclosure is not limited thereto. For example, the bubble 16 may communicate with the atmosphere outside the discharge port 11 (on the atmosphere side) or the bubble 16 may disappear without communicating with the atmosphere.

Rate of Liquid in Discharge Liquid Droplet

FIG. 8A to FIG. 8G are diagrams for comparing discharge liquid droplets in the case where the water phase thickness ratio $h_r$ is changed in a stepwise manner in the liquid channel 13 (pressure chamber) of which the channel (pressure chamber) height is H [μm]=20 μm. The water phase thickness ratio $h_r$ is increased in the increments of 0.10 from FIG. 8A to FIG. 8F, and the water phase thickness ratio $h_r$ is increased in the increments of 0.50 from FIG. 8F to FIG. 8G. Discharge liquid droplets in FIG. 8A to FIG. 8G are shown in accordance with the results obtained through simulations performed under the conditions that the viscosity of the first liquid is 1 cP, the viscosity of the second liquid is 8 cP, and the liquid droplet discharge velocity is 11 m/s.

As shown in FIG. 4D, the water phase thickness $h_1$ of the first liquid 31 reduces as the water phase thickness ratio $h_r$ ($=h_1/(h_1+h_2)$) approaches zero, and the water phase thickness $h_1$ of the first liquid 31 increases as the water phase thickness ratio $h_r$ approaches one. For this reason, a liquid mainly contained in the discharge liquid droplet 30 is the second liquid 32 closer to the discharge port 11; however, as the water phase thickness ratio $h_r$ approaches one, the rate of the first liquid 31 contained in the discharge liquid droplet 30 also increases.

In the case of FIG. 8A to FIG. 8G in which the channel (pressure chamber) height is H [μm]=20 μm, only the second liquid 32 is included in the discharge liquid droplet 30 and no first liquid 31 is included in the discharge liquid droplet 30 at the water phase thickness ratio $h_r$=0.00, 0.10, or 0.20. However, the first liquid 31 is also included in the discharge liquid droplet 30 together with the second liquid 32 at the water phase thickness ratio $h_r$=0.30 or higher, and only the first liquid 31 is included in the discharge liquid droplet 30 at the water phase thickness ratio $h_r$=1.00 (that is, a state where no second liquid is present). In this way, the ratio between the first liquid and the second liquid, included in the discharge liquid droplet 30, varies with the water phase thickness ratio $h_r$ in the liquid channel 13.

On the other hand, FIG. 9A to FIG. 9E are diagrams for comparing discharge liquid droplets 30 in the case where the water phase thickness ratio $h_r$ is changed in a stepwise manner in the liquid channel 13 of which the channel (pressure chamber) height is H [μm]=33 μm. In this case, only the second liquid 32 is included in the discharge liquid droplet 30 in the range of the water phase thickness ratio up to $h_r$=0.36, and the first liquid 31 is also included in the discharge liquid droplet 30 together with the second liquid 32 in the range of the water phase thickness ratio from $h_r$=0.48.

Figure 10A:
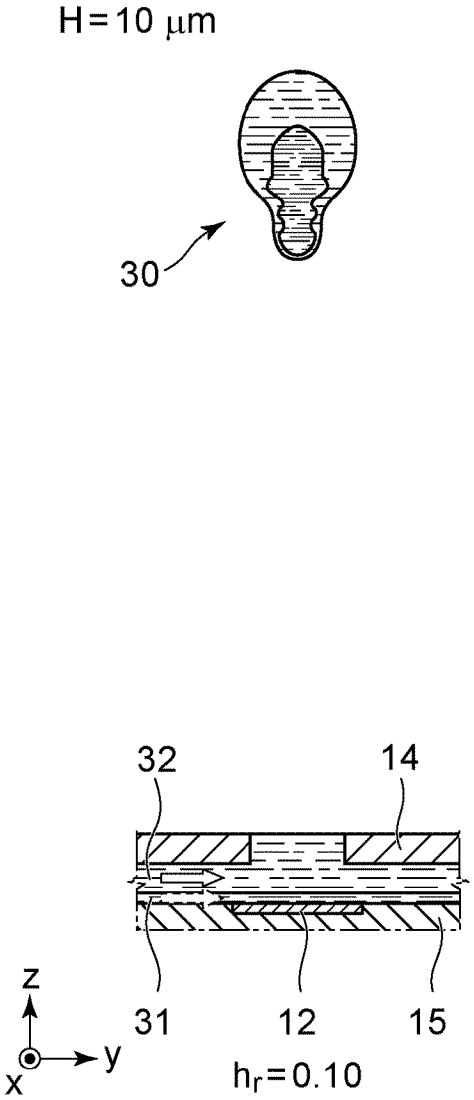
FIG. 10A to FIG. 10C are diagrams showing discharge liquid droplets for various water phase thickness ratios.
Figure 10B:
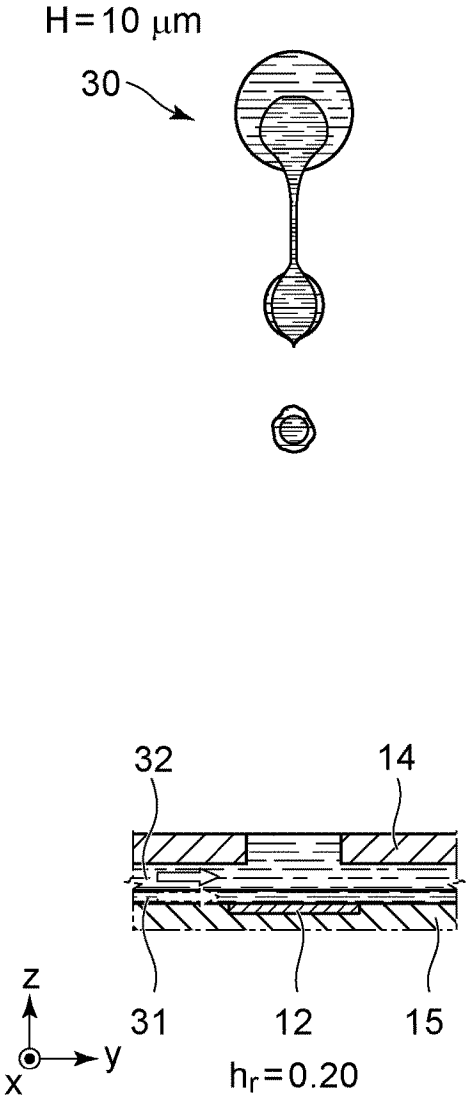
Figure 10C:
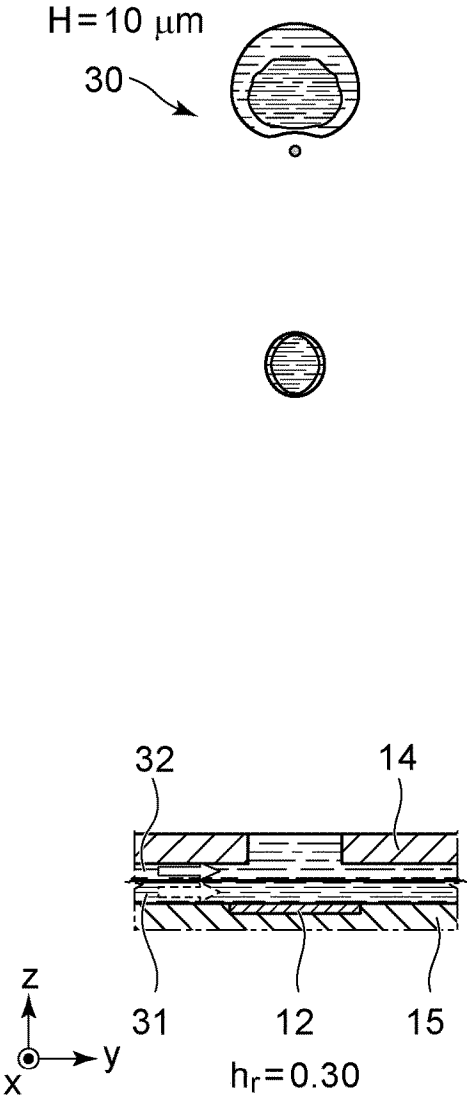

FIG. 10A to FIG. 10C are diagrams for comparing discharge liquid droplets 30 in the case where the water phase thickness ratio $h_r$ is changed in a stepwise manner in the liquid channel 13 of which the channel (pressure chamber) height is H [μm]=10 μm. In this case, even when the water phase thickness ratio is $h_r$=0.10, the first liquid 31 is included in the discharge liquid droplet 30.

Figure 11:
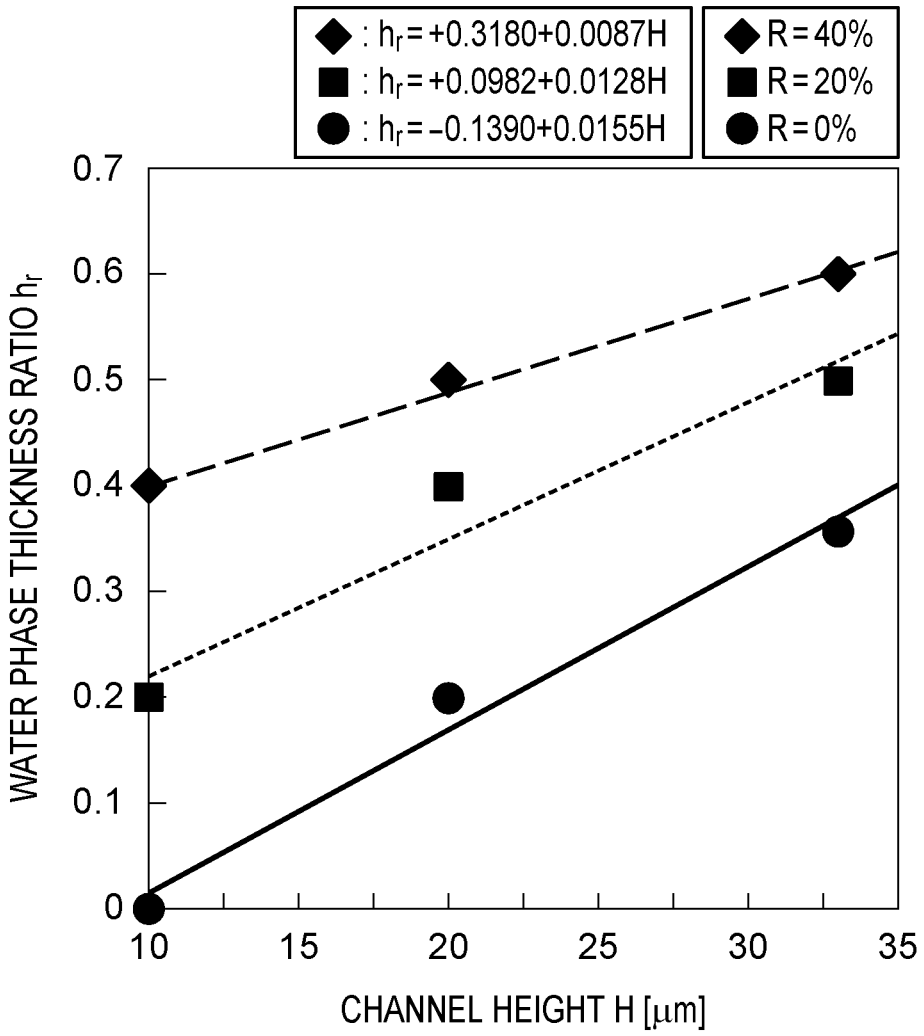
FIG. 11 is a graph showing the relationship between the height of a channel (pressure chamber) and water phase thickness ratio.

FIG. 11 is a graph showing the relationship between channel (pressure chamber) height H and water phase thickness ratio $h_r$ in the case of a fixed rate R at which the first liquid 31 is included in the discharge liquid droplet 30 where the rate R is set to 0%, 20%, or 40%. At any rate R, as the channel (pressure chamber) height H increases, the desired water phase thickness ratio $h_r$ also increases. Here, a rate R at which the first liquid 31 is included means a rate at which a liquid flowing as the first liquid 31 in the liquid channel 13 (pressure chamber) is included in a discharge liquid droplet. Thus, even when each of the first liquid and the second liquid contains the same ingredient like, for example, water, water contained in the second liquid is, of course, not reflected in the rate.

When only the second liquid 32 is included in the discharge liquid droplet 30 and no first liquid is included in the discharge liquid droplet 30 (R=0%), the relationship between channel (pressure chamber) height H [μm] and water phase thickness ratio $h_r$ takes the locus represented by the continuous line in the graph. According to the study of the present disclosers, a water phase thickness ratio $h_r$ can be approximated as a linear function of channel (pressure chamber) height H [μm], expressed by the equation 3.

$$h_r=-0.1390+0.0155H \tag{3}$$

When 20% first liquid is intended to be included in the discharge liquid droplet 30 (R≤20%), the water phase thickness ratio $h_r$ can be approximated as a linear function of channel (pressure chamber) height H [μm], expressed by the equation 4.

$$h_r=+0.0982+0.0128H \tag{4}$$

Furthermore, when 40% first liquid is intended to be included in the discharge liquid droplet 30 (R=40%), the water phase thickness ratio $h_r$ can be approximated as a linear function of channel (pressure chamber) height H [μm], expressed by the equation 5, according to the study of the present disclosers.

$$h_r=+0.3180+0.0087H \tag{5}$$

When, for example, no first liquid is intended to be included in the discharge liquid droplet 30, the water phase thickness ratio $h_r$ needs to be adjusted to 0.20 or lower when the channel (pressure chamber) height H [μm] is 20 μm. The water phase thickness ratio $h_r$ needs to be adjusted to 0.36 or lower when the channel (pressure chamber) height H [μm] is 33 μm. Furthermore, the water phase thickness ratio $h_r$ needs to be adjusted to substantially zero (0.00) when the channel (pressure chamber) height H [μm] is 10 μm.

However, when the water phase thickness ratio $h_r$ is reduced too much, the viscosity $\eta_2$ and flow rate $Q_2$ of the second liquid relative to the first liquid need to be increased, so there are concerns about inconvenience resulting from an increase in pressure loss. For example, referring to FIG. 5A again, when the water phase thickness ratio $h_r$=0.20 is achieved, the flow rate ratio $Q_r$=5 for the viscosity ratio $\eta_r$=10. If the water phase thickness ratio $h_r$ is set to 0.10 in order to obtain reliability of not discharging the first liquid while using the same inks (that is, the same viscosity ratio $\eta_r$), the flow rate ratio $Q_r$=15. In other words, when the water phase thickness ratio $h_r$ is adjusted to 0.10, the flow rate ratio $Q_r$ needs to be increased to three times as compared to the case where the water phase thickness ratio $h_r$ is adjusted to 0.20, so there are concerns about an increase in pressure loss and accompanying inconvenience.

From above, when only the second liquid 32 is intended to be discharged while pressure loss is minimized, it is desirable that the water phase thickness ratio $h_r$ be set to a large value as much as possible under the above conditions. When specifically described with reference to FIG. 11 again, it is desirable that the water phase thickness ratio $h_r$ be less than 0.20 and adjusted to a value close to 0.20 as much as possible when, for example, the channel (pressure chamber) height is H [μm]=20 μm. When the channel (pressure chamber) height is H [μm]=33 μm, it is desirable that the water phase thickness ratio $h_r$ be less than 0.36 and adjusted to a value close to 0.36 as much as possible.

The above-described equations 3, 4, and 5 are numeric values in a general liquid discharge head, that is, a liquid discharge head of which the discharge velocity of discharge liquid droplets falls within the range of 10 m/s to 18 m/s. Also, the equations 3, 4, and 5 are numeric values on the assumption that the pressure generating element and the discharge port are located so as to face each other and the first liquid and the second liquid flow such that the pressure generating element, the first liquid, the second liquid, and the discharge port are arranged in this order in the pressure chamber.

In this way, according to the present embodiment, it is possible to stably perform discharge operation of liquid droplets in which the first liquid and the second liquid are included at a constant ratio, by stabilizing the interface with the water phase thickness ratio $h_r$ in the liquid channel 13 (pressure chamber), set to a predetermined value.

Incidentally, in order to repeatedly perform the above-described discharge operation in a stable state, it is desired to stabilize the interface position regardless of the frequency of discharge operation while achieving the intended water phase thickness ratio $h_r$.

Here, a specific method for achieving such a state will be described with reference to FIG. 4A to FIG. 4C again. For example, to adjust the flow rate $Q_1$ of the first liquid in the liquid channel 13 (pressure chamber), a first pressure difference generation mechanism in which the pressure in the first communication collecting channel 25 is lower than the pressure in the first communication supply channel 20 just needs to be prepared. With this configuration, the flow of the first liquid 31 from the first communication supply channel 20 toward the first communication collecting channel 25 (y direction) is generated. In addition, a second pressure difference generation mechanism in which the pressure in the second communication collecting channel 26 is lower than the pressure in the second communication supply channel 21 just needs to be prepared. With this configuration, the flow of the second liquid 32 from the second communication supply channel 21 toward the second communication collecting channel 26 (y direction) is generated.

Then, in a state where the first pressure difference generation mechanism and the second pressure difference generation mechanism are controlled in a state where the relationship of the equation 6 is maintained in order not to generate backflow in the channel, a parallel flow of the first liquid and the second liquid, which flow in the y direction at a desired water phase thickness ratio $h_r$ in the liquid channel 13, can be formed.

$$P2in \geq P1in > P1out \geq P2out \quad (6)$$

Here, P1in denotes the pressure in the first communication supply channel 20, P1out denotes the pressure in the first communication collecting channel 25, P2in denotes the pressure in the second communication supply channel 21, and P2out denotes the pressure in the second communication collecting channel 26. In this way, when it is possible to maintain a predetermined water phase thickness ratio $h_r$ in the liquid channel (pressure chamber) by controlling the first and second pressure difference generation mechanisms, a suitable parallel flow is recovered in a short time and the next discharge operation is immediately started even when the interface position is disrupted as a result of discharge operation.

Specific Example of First Liquid and Second Liquid

With the configuration of the above-described present embodiment, the first liquid is a bubbling medium for causing film boiling to occur and the second liquid is a discharge medium to be discharged from the discharge port to the outside, so functions desired for the respective liquids are clear. With the configuration of the present embodiment, the flexibility of ingredients to be contained in the first liquid and the second liquid is increased as compared to the existing art. Hereinafter, the thus configured bubbling medium (first liquid) and discharge medium (second liquid) will be described in detail by way of a specific example.

The bubbling medium (first liquid) of the present embodiment is desired to cause film boiling to occur in the bubbling medium at the time when the electrothermal converter generates heat and, as a result, the generated bubble rapidly increases, that is, to have a high critical pressure capable of efficiently converting thermal energy to bubbling energy. Water is suitable as such a medium. Water has a high boiling point (100° C.) and a high surface tension (58.85 dyne/cm at 100° C.) although the molecular weight is 18 and small, and has a high critical pressure of about 22 MPa. In other words, a bubbling pressure at the time of film boiling is also exceedingly high. Generally, in an ink jet printing apparatus of a type of discharging ink by using film boiling as well, ink in which a color material, such as dye and pigment, is contained in water is suitably used.

However, a bubbling medium is not limited to water. When the critical pressure is higher than or equal to 2 MPa (preferably, higher than or equal to 5 MPa), a medium is capable of serving the function as a bubbling medium. Examples of the bubbling medium other than water include methyl alcohol and ethyl alcohol, and a mixture of any one or both of these liquids with water may also be used as a bubbling medium. A liquid containing the above-described color material, such as dye and pigment, other additives, or the like in water may also be used.

On the other hand, the discharge medium (second liquid) of the present embodiment does not need physical properties for causing film boiling to occur unlike the bubbling medium. When kogation adheres onto the electrothermal converter (heater), there are concerns that the smoothness of the heater surface is impaired or the thermal conductivity decreases to cause a decrease in bubbling efficiency; however, the discharge medium does not directly contact with the heater, so ingredients contained in the discharge medium are less likely to become charred. In other words, in the discharge medium of the present embodiment, physical property conditions for generating film boiling or avoiding kogation are relieved as compared to ink for an existing thermal head, the flexibility of ingredients contained increases, with the result that the discharge medium can further actively contain ingredients appropriate for uses after discharged.

For example, pigments not used in the existing art for the reason that the pigments easily become charred on the heater can be actively contained in the discharge medium in the present embodiment. Liquids other than aqueous inks having an exceedingly small critical pressure may also be used as the discharge medium in the present embodiment. Furthermore, various inks having special functions, which have been difficult for the existing thermal head to support, such as an ultraviolet curable ink, a conductive ink, an EB (electron beam) curable ink, a magnetic ink, and a solid ink, can be used as the discharge medium. When blood, cells in a culture solution, or the like is used as a discharge medium, the liquid discharge head of the present embodiment may be used for various uses other than image formation. It is also effective for uses of fabrication of biochips, printing of electronic circuits, and the like.

Particularly, a mode in which the first liquid (bubbling medium) is water or a liquid similar to water and the second liquid (discharge medium) is a pigment ink having a higher viscosity than water and then only the second liquid is discharged is one of effective uses of the present embodiment. In such a case as well, as shown in FIG. 5A, it is effective that the water phase thickness ratio $h_r$ is suppressed by minimizing the flow rate ratio $Q_r=Q_2/Q_1$. The second liquid is not limited, so the same liquids as listed for the first liquid may be used. Even when, for example, two liquids each are an ink containing a large amount of water, one of the inks may be used as the first liquid and the other one of the inks may be used as the second liquid according to a situation, for example, a mode of use.

Ultraviolet Curable Ink as One Example of Discharge Medium

An ingredient composition of an ultraviolet curable ink usable as the discharge medium of the present embodiment will be described as an example. Ultraviolet curable inks are classified into 100% solid inks made of a polymerizable reactive ingredient without containing a solvent and solvent inks containing water or a solvent as a diluent. Ultraviolet curable inks widely used in recent years are 100% solid ultraviolet curable inks made of a nonaqueous photopolymerizable reactive ingredient (monomer or oligomer) without containing a solvent. The composition includes a monomer as a main ingredient and includes a small amount of other additives such as a photopolymerization initiator, a color material, a dispersant, and a surfactant. The ratio among the monomer, the photopolymerization initiator, the color material, and the other additives is about 80 to 90 wt %:5 to 10 wt %:2 to 5 wt %:remainder. In this way, for even ultraviolet curable inks that have been difficult for the existing thermal head to support, when the ultraviolet curable inks are used as the discharge medium of the present embodiment, the ultraviolet curable inks can be discharged from the liquid discharge head through stable discharge operation. Thus, it is possible to print images more excellent in image fastness and scratch resistance than the existing art.

Example in which Discharge Liquid Droplet is Mixed Solution

Next, the case where the discharge liquid droplet 30 in which the first liquid 31 and the second liquid 32 are mixed at a predetermined ratio is discharged will be described. For example, in the case where the first liquid 31 and the second liquid 32 are different color inks, when the relation in which the Reynolds number calculated by using the viscosities and flow rates of both liquids is lower than a predetermined value is satisfied, these inks form a laminar flow without mixing with each other in the liquid channel 13 and the pressure chamber 18. In other words, by controlling the flow rate ratio $Q_r$ between the first liquid 31 and the second liquid 32 in the liquid channel 13 and the pressure chamber 18, the water phase thickness ratio $h_r$, by extension, the mixing ratio between the first liquid 31 and the second liquid 32 in the discharge liquid droplet, can be adjusted to a desired ratio.

When, for example, the first liquid is a clear ink and the second liquid is a cyan ink (or a magenta ink), a light cyan ink (or a light magenta ink) having various color material densities can be discharged by controlling the flow rate ratio $Q_r$. Alternatively, when the first liquid is a yellow ink and the second liquid is a magenta ink, multiple-type red inks of which hues are different in a stepwise manner can be discharged by controlling the flow rate ratio $Q_r$. In other words, when a liquid droplet in which the first liquid and the second liquid are mixed at a desired ratio can be discharged, a color reproduction range expressed by a print medium can be expanded as compared to the existing art by adjusting the mixing ratio.

Alternatively, when two-type liquids that are desirably not mixed until just before discharge and mixed just after the discharge are used as well, the configuration of the present embodiment is effective. There is, for example, a case where, in image printing, it is desirable to simultaneously apply a high concentration pigment ink excellent in color development and resin emulsion (resin EM) excellent in fastness like scratch resistance to a print medium. However, a pigment ingredient in the pigment ink and a solid content in the resin EM easily aggregate when an interparticle distance is proximate and tend to impair dispersibility. Thus, when, in the present embodiment, the first liquid 31 is a high concentration resin emulsion (resin EM) and the second liquid 32 is a high concentration pigment ink and then a parallel flow is formed by controlling the flow velocities of these liquids, the two liquids mix and aggregate on a print medium after discharged. In other words, it is possible to obtain an image having high color development and high fastness after landed while maintaining a suitable discharge state under high dispersibility.

When such mixing of two liquids after discharged is intended, the effectiveness of flowing two liquids in the pressure chamber is exercised irrespective of the mode of the pressure generating element. In other words, even in such a configuration that restrictions on critical pressure or issues of kogation are originally not raised as in the case of, for example, a configuration in which a piezoelectric element is used as the pressure generating element, the present disclosure effectively functions.

As described above, according to the present embodiment, in a state where the first liquid and the second liquid are caused to steadily flow while maintaining a predetermined water phase thickness ratio $h_r$ in the liquid channel (pressure chamber), it is possible to stably perform good discharge operation by driving the pressure generating element 12.

By driving the pressure generating element 12 in a state where liquids are caused to steadily flow, a stable interface can be formed at the time of discharging liquid. When no liquid is flowing at the time of liquid discharge operation, the interface is easily disrupted due to occurrence of a bubble, which also influences printing quality. As in the case of the present embodiment, when the pressure generating element 12 is driven while liquids are caused to flow, disruption of the interface due to occurrence of a bubble can be suppressed. Since a stable interface is formed, for example, the content ratio of various liquids in discharge liquid becomes stable, and printing quality also gets better. Since liquids are caused to flow before driving the pressure generating element 12 and liquids are caused to flow also at the time of discharging, a time for forming a meniscus again in the liquid channel (pressure chamber) after liquid is discharged is shortened. A flow of liquid is performed by a pump or the like installed in the liquid circulation unit 504 before a drive signal for the pressure generating element 12 is input. Therefore, liquid is flowing at least just before liquid is discharged.

The first liquid and the second liquid, flowing in the pressure chamber, may circulate through the outside of the pressure chamber. When no circulation is performed, there occurs a large amount of liquid not discharged, of the first liquid and the second liquid forming a parallel flow in the liquid channel and the pressure chamber. For this reason, when the first liquid and the second liquid are caused to circulate through the outside, it is possible to use liquid not discharged in order to form a parallel flow again.

Communication Channels

Figure 12A:
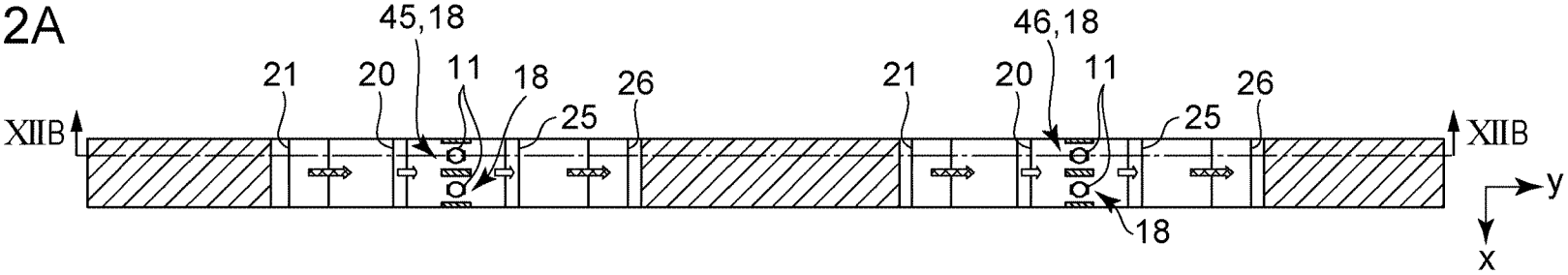
FIG. 12A and FIG. 12B are top view and cross-sectional view of a liquid channel of a comparative example.
Figure 12B:
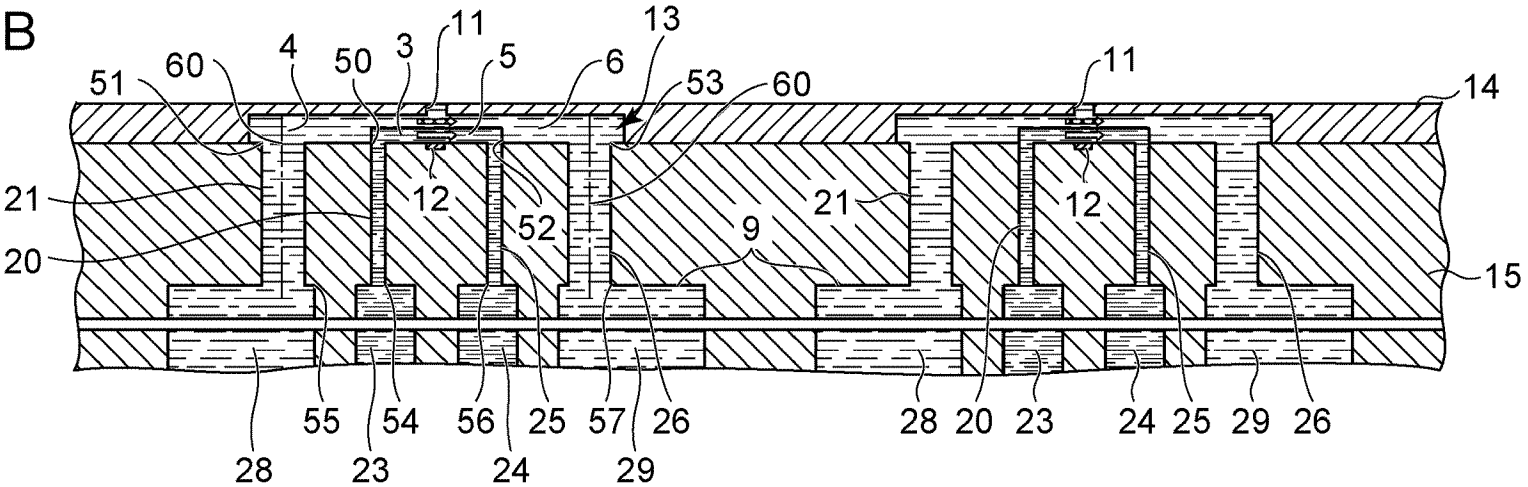
Figure 13A:
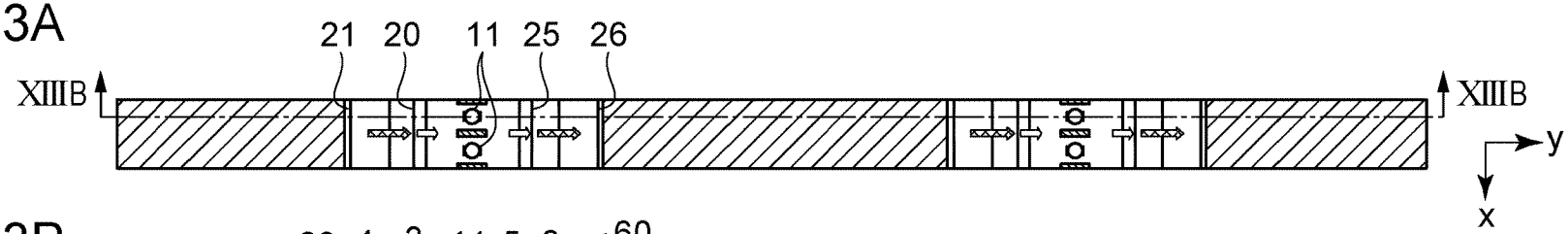
FIG. 13A to FIG. 13C are top view and cross-sectional views of the liquid channel of the first embodiment.
Figure 13B:
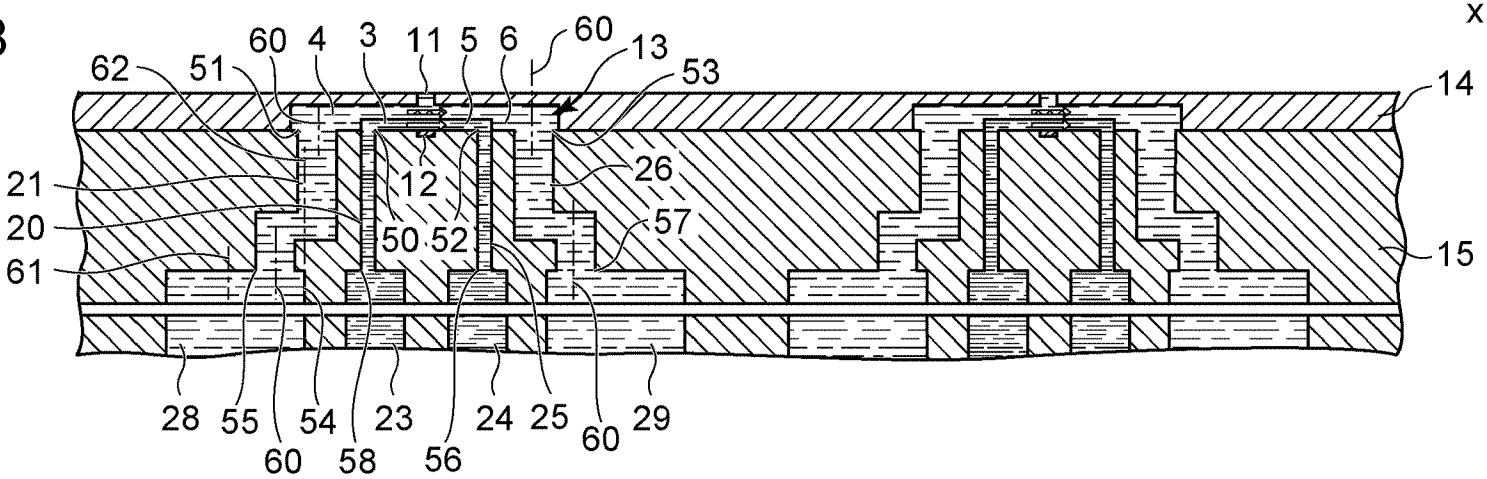
Figure 13C:
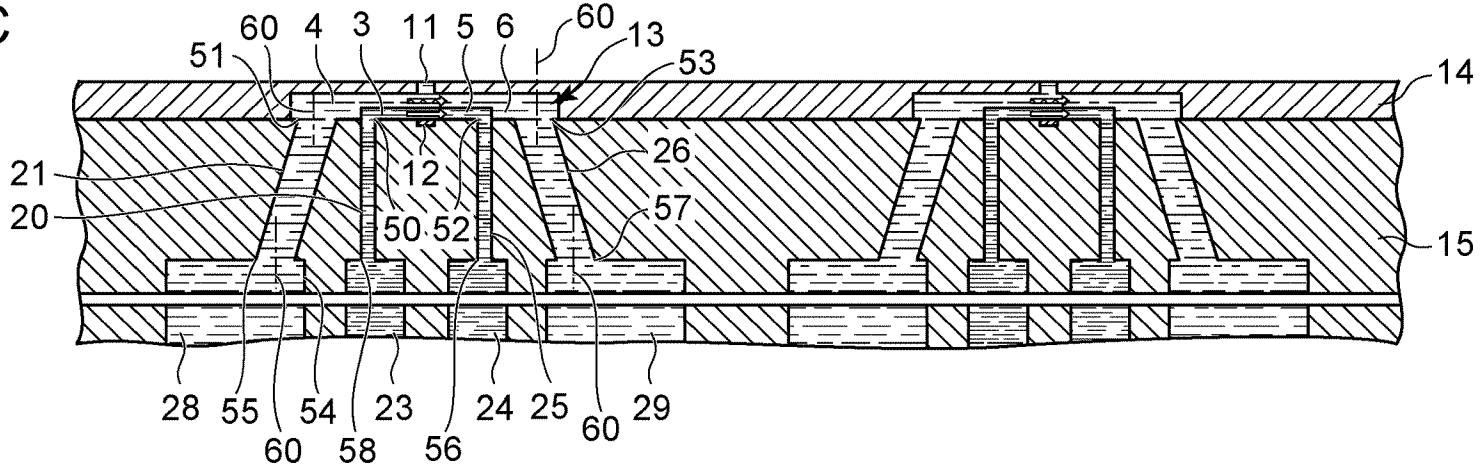

The configuration of channels formed in the substrate 15 will be described with reference to FIG. 12A to FIG. 13C. FIG. 12A is a top view showing the configuration of channels of a comparative example according to the present disclosure. FIG. 12B is a cross-sectional view taken along the line XIIB-XIIB in FIG. 12A. FIG. 13A is a top view showing the configuration of channels according to the present embodiment. FIG. 13B is a cross-sectional view taken along the line XIIIB-XIIIB in FIG. 13A. FIG. 13C is a modification of communication channels shown in FIG. 13B. In FIG. 3, one of each of the first communication supply channel 20, the second communication supply channel 21, the first communication collecting channel 25, and the second communication collecting channel 26 is formed in association with each discharge port 11. However, in FIG. 12A to FIG. 13C, one of each of the first communication supply channel 20, the second communication supply channel 21, the first communication collecting channel 25, and the second communication collecting channel 26 is formed in association with a plurality of discharge ports. The present disclosure may be applied to any mode without difficulty. This also applies to FIG. 14A and FIG. 14B related to a second embodiment (described later).

In the liquid channel 13 that communicates with the pressure chamber 18, a region to supply the first liquid 31 to the pressure chamber 18 is referred to as first supply channel 3, and a region to supply the second liquid 32 to the pressure chamber 18 is referred to as second supply channel 4. In the liquid channel 13 that communicates with the pressure chamber 18, a region to collect the first liquid 31 from the pressure chamber 18 is referred to as first collecting channel 5, and a region to collect the second liquid 32 from the pressure chamber 18 is referred to as second collecting channel 6. In the present embodiment, the communication channels are formed in order of the second communication supply channel 21, the first communication supply channel 20, the first communication collecting channel 25, and the second communication collecting channel 26. In the y direction, the second communication supply channel 21, the first communication supply channel 20, the pressure generating element 12, the first communication collecting channel 25, and the second communication collecting channel 26 are arranged in this order.

The first communication supply channel 20 communicates with the first supply channel 3 via a first communication supply opening 50 and communicates with the first common supply channel 23 via a first common supply opening 54. The second communication supply channel 21 communicates with the second supply channel 4 via a second communication supply opening 51 and communicates with the second common supply channel 28 via a second common supply opening 55. The first communication collecting channel 25 communicates with the first collecting channel 5 via a first communication collecting opening 52 and communicates with the first common collecting channel 24 via a first common collecting opening 56. The second communication collecting channel 26 communicates with the second collecting channel 6 via a second communication collecting opening 53 and communicates with the second common collecting channel 29 via a second common collecting opening 57.

In FIG. 12A and FIG. 12B showing the comparative example, each of the communication channels (the first communication supply channel 20, the second communication supply channel 21, the first communication collecting channel 25, and the second communication collecting channel 26) is formed so as to extend vertically from a corresponding one of the common channels toward the liquid channel 13. For this reason, the length of the liquid channel 13 tends to increase. Thus, flow resistance increases, with the result that liquid supply efficiency decreases and it is difficult to reduce the water phase thickness ratio $h_r$. To reduce the water phase thickness ratio $h_r$, the flow rate ratio $Q_r$ needs to be increased. However, to increase the flow rate ratio $Q_r$ in the case where flow resistance increases, a larger pressure difference needs to be generated.

In the present embodiment, in the substrate 15, the communication channels are formed as bend channels (hereinafter, referred to as crank channels) such that a central axis 60 of the liquid channel 13-side opening of each communication channel is located closer to the pressure chamber than a central axis 60 of the common channel-side opening of the communication channel. Specifically, in FIG. 13A to FIG. 13C, the central axis 60 of the second communication supply opening 51 of the second communication supply channel 21 is located closer to the pressure chamber 18 than the central axis 60 of the second common supply opening 55 of the second communication supply channel 21. Similarly, the central axis 60 of the second communication collecting opening 53 of the second communication collecting channel 26 is located closer to the pressure chamber 18 than the central axis 60 of the second common collecting opening 57. With this configuration, the length of the liquid channel 13 is reduced as compared to the comparative example, so it is possible to suppress a decrease in the efficiency of supplying liquid and difficulty in reducing the water phase thickness ratio $h_r$. The crank channels as in the case of the present embodiment can be formed by laminating a plurality of silicon substrates having channels.

In terms of the strength of the substrate 15, an extent to which the second common supply channel 28 is located close to the first common supply channel 23 is limited. For this reason, the substrate 15 having a certain thickness is present between the second common supply channel 28 and the first common supply channel 23. In the present embodiment, it is desirable that the central axis 60 of the second communication supply opening 51 be shifted such that the central axis 60 of the second communication supply opening 51 is located closer to the pressure chamber than an extension line 62 of the wall 58, adjacent to the pressure chamber, of the second common supply channel 28. The same applies to cases where, of the communication channels, another channel is employed as the configuration of the present embodiment. In other words, when, for example, the second communication collecting channel 26 is a crank channel, it is desirable that the central axis of the second communication collecting opening 53 be shifted such that the central axis of the second communication collecting opening 53 is located closer to the pressure chamber than the extension line of the wall, adjacent to the pressure chamber, of the second common collecting channel 29. This also applies to the case where the first communication supply channel 20 is a crank channel and the case where the first communication collecting channel 25 is a crank channel.

In FIG. 13A to FIG. 13C, the second common supply opening 55 is formed such that the central axis 60 of the second common supply opening 55 is located closer to the pressure chamber than the central axis 61 of the second common supply channel 28. However, the embodiment is not limited thereto. In other words, the second common supply opening 55 may be formed such that the central axis 60 of the second common supply opening 55 is located across the central axis 61 of the second common supply channel 28 from the pressure chamber side. However, in such a case, the length of the second communication supply channel 21 increases, and liquid supply efficiency in the second communication supply channel 21 decreases. For this reason, it is desirable that the second common supply opening 55 be formed such that the central axis 60 of the second common supply opening 55 is located closer to the pressure chamber than the central axis 61 of the second common supply channel 28.

Even in the case of the configuration of crank channels as shown in FIG. 13B, a total distance of the channel from a common channel to the pressure chamber 18 is not so different from that of the comparative example shown in FIG. 12B. Generally, the second communication supply channel 21 and the second communication collecting channel 26 each have a larger cross-section area than the cross-section area of the liquid channel 13. Here, the cross-section area of a channel is the area of the channel in a direction orthogonal to an extending direction of the channel and is defined as an average value of cross-section areas at 10 points arbitrarily selected in the direction in which the channel extends. With the crank channels as shown in FIG. 13B, the channels at portions where the cross-section area is large and the flow resistance is small can be elongated, and the channels at portions where the cross-section area is small and the flow resistance is large can be shortened. With this configuration, the above-described advantages (suppressing a decrease in liquid supply efficiency and suppressing difficulty in reducing the water phase thickness ratio $h_r$) are obtained.

In FIG. 13B, the configuration in which, of the communication channels, the channels through which the second liquid 32 flows are crank channels is shown; however, the present disclosure is not limited thereto. In other words, of the communication channels, the central axis of the pressure chamber-side opening of at least any one of the communication channels just needs to be shifted so as to be located closer to the pressure chamber than the central axis of the common channel-side opening. Therefore, the channels through which the first liquid 31 flows may be crank channels. Generally, the viscosity of the second liquid 32 is greater than the viscosity of the first liquid 31, so the efficiency of supplying the second liquid 32 tends to decrease. For this reason, it is desirable that the communication channels through which the second liquid 32 flows be crank channels.

It is desirable that the number of bends of one crank channel be one. The fact that a crank channel bends once means that, when the second communication supply channel 21 is taken for example, when viewed from the second common supply channel 28 side, the extending direction of the channel changes to the y direction once and then the direction in which the channel extends changes to −x direction. In other words, the crank channels shown in FIG. 13B each bend once. The crank channels of the present embodiment are not limited to the single-bend crank channels. The channels may bend two or more times. However, as the number of bends increases, it becomes complicated to form a crank channel, so a single-bend crank channel is desirable from the viewpoint of formation.

The crank channels are shown in FIG. 13B; however, the present disclosure is not limited thereto. In other words, even when a communication channel does not bend and has a linear shape, the central axis 60 of the liquid channel 13-side opening just needs to be located closer to the pressure chamber 18 than the central axis 60 of the common channel-side opening. The shape of such a communication channel may be a linear shape such that, as shown in FIG. 13C, a channel inclined from the common channel toward the liquid channel 13 (inclined with respect to the substrate surface) extends.

Second Embodiment

Figure 14A:
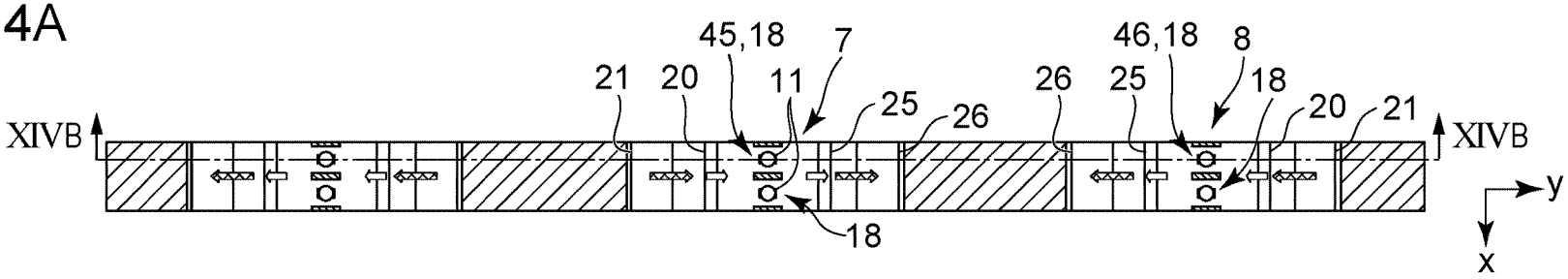
FIG. 14A and FIG. 14B are top view and cross-sectional view of a liquid channel of a second embodiment.
Figure 14B:
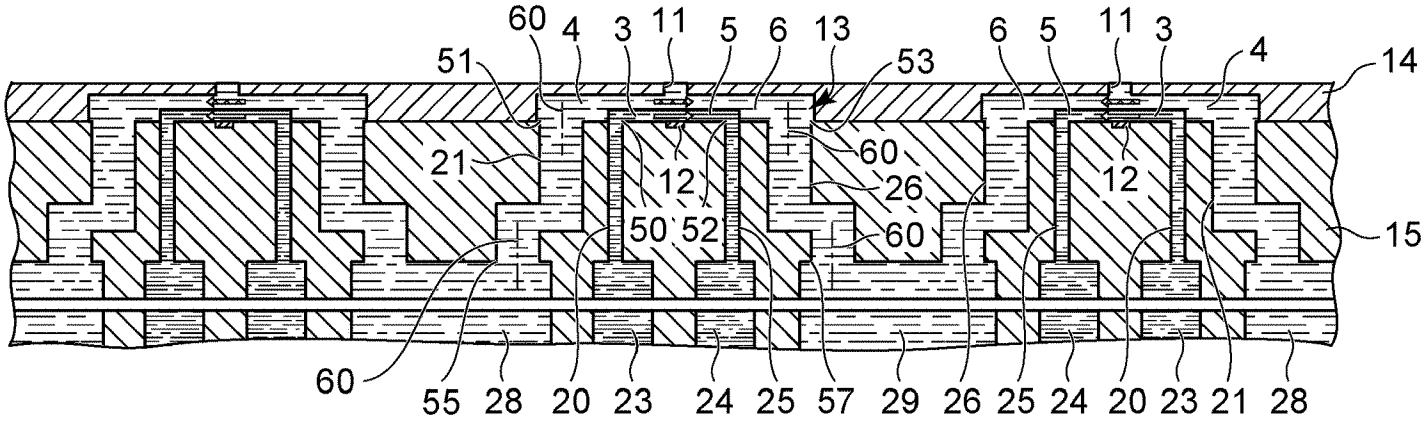

The second embodiment of the present disclosure will be described with reference to FIG. 14A and FIG. 14B. Like reference denote similar portions to those of the first embodiment, and the description thereof is omitted. FIG. 14A is a top view showing the configuration of channels according to the present embodiment. FIG. 14B is a cross-sectional view taken along the line XIVB-XIVB in FIG. 14A. A plurality of the pressure chambers 18 is arranged in the x direction, a plurality of the pressure chambers 18 arranged in the x direction on the left side in FIG. 12A and FIG. 12B and in the middle in FIG. 14A and FIG. 14B is referred to as first pressure chamber row 7, and a plurality of the pressure chambers 18 arranged in the x direction on the right side in FIG. 12A and FIG. 12B and on the right side in FIG. 14A and FIG. 14B is referred to as second pressure chamber row 8. The second pressure chamber row 8 is a pressure chamber row arranged next to the first pressure chamber row 7.

Four channels, that is, the first common supply channel 23, the first common collecting channel 24, the second common supply channel 28, and the second common collecting channel 29, are provided for each of the first and second pressure chamber rows 7, 8. For this reason, sufficient space needs to be reserved between the first pressure chamber row 7 and the second pressure chamber row 8 in order to form these channels in the substrate 15, so there are concerns that the size of the element substrate 10 increases.

In the present embodiment, of the common channels located between the first pressure chamber row 7 and the second pressure chamber row 8, the channels closer to the other pressure chamber row communicate with those of the first pressure chamber row 7 and the second pressure chamber row 8. Specifically, in FIG. 14A and FIG. 14B, the second common collecting channel 29 communicates with the second communication collecting channels 26 communicating with first pressure chambers 45 and second communication collecting channels 26 communicating with second pressure chambers 46. With this configuration, one common channel is capable of collecting the second liquid 32 from two pressure chambers. In other words, a common channel is shared between the first pressure chambers 45 and the second pressure chambers 46. For this reason, the number of common channels in the present embodiment is made less than the number of common channels communicating with the first pressure chambers 45 and the second pressure chambers 46 in the comparative example shown in FIG. 12A and FIG. 12B. With this configuration, a space that would be provided between the first pressure chamber row 7 and the second pressure chamber row 8 to form common channels is reduced, so the size of the element substrate 10 is reduced. Specifically, according to the present embodiment, the size of the element substrate 10 is reduced by the amount of a substrate 9 between the second common supply channel 28 communicating with the first pressure chamber row 7 and the second common supply channel 28 communicating with the second pressure chamber row 8 in FIG. 12A and FIG. 12B.

According to the present embodiment, the number of the first common supply channels 23, the number of the first common collecting channels 24, the number of the second common supply channels 28, and the number of the second common collecting channels 29, formed in the element substrate 10, each are less than the number of discharge port rows formed in the element substrate 10.

Generally, a pressure loss ΔP [kPa] in a channel is expressed by the formula 7 by using a flow rate Q [$\mu m^3/\mu s$] and a flow resistance R [$kPa*\mu m/\mu m^3$].

$$\Delta P = Q \times R \tag{7}$$

Here, it is known that the flow resistance R [kPa*μm/μm$^3$] influences the square of cross-section area S [μm$^2$]. In other words, the following relationship holds.

$$R \propto (1/S^2) \quad (8)$$

Therefore, when the cross-section area of the second common collecting channel 29 in FIG. 14B is made not twice but just about 1.4 times as large as the second common collecting channel 29 shown in FIG. 12B, a pressure loss in the common channels can be suppressed to a pressure loss that occurs in the configuration of FIG. 12B. Therefore, with the configuration of the present embodiment, not only the size of the element substrate 10 can be reduced by the amount of the substrate 9 of FIG. 12B, but also the cross-section area of the second common collecting channel 29 can be reduced to less than the sum of the cross-section areas of the two channels, so the present embodiment further contributes to a reduction in the size of the element substrate 10.

In FIG. 12A and FIG. 12B showing the comparative example, the direction in which liquid flows in each pressure chamber is the same direction (y direction). However, in FIG. 14A and FIG. 14B showing the present embodiment, common channels are shared, so the direction in which liquid flows varies among pressure chamber rows. Specifically, the flow of liquid flowing in each first pressure chamber 45 is in a positive y direction, and the flow of liquid flowing in each second pressure chamber 46 is in a negative y direction. Therefore, in the configuration of channels in the present embodiment, the flow direction of liquid needs to be changed as needed for each pressure chamber row.

The present embodiment is not limited to sharing the second common collecting channels 29. As shown in FIG. 14B, the second common supply channel 28 may communicate with the second communication supply channels 21 of the first pressure chambers 45 and the second communication supply channels 21 of the second pressure chambers 46. Furthermore, channels may be formed in order of the first common supply channel 23, the second common supply channel 28, the second common collecting channel 29, and the first common collecting channel 24, and the first common supply channel 23 and the first common collecting channel 24 each may be shared. However, generally, the viscosity of the second liquid is greater than the viscosity of the first liquid, so a pressure loss of the second liquid that flows through the second common supply channel 28 and the second common collecting channel 29 is larger than a pressure loss of the first liquid 31. For this reason, to reduce a pressure loss, the cross-section area of each of the second common supply channel 28 and the second common collecting channel 29 is greater than the cross-section area of each of the first common supply channel 23 and the first common collecting channel 24. It is found from the equation 7 and the equation 8 that the width of a channel to be reduced is larger when a channel having a larger cross-section area is shared. For this reason, sharing the second common supply channel 28 or the second common collecting channel 29, through which the second liquid 32 flows, is more desirable from the viewpoint of suppressing an increase in the size of the element substrate 10.

According to the present disclosure, it is possible to provide a liquid discharge head capable of suppressing a decrease in liquid supply efficiency while forming the flow of two liquids.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-011242, filed Jan. 27, 2020, which is hereby incorporated by reference herein in its entirety.

What is claimed is:

1. A liquid discharge head comprising:

a substrate;

a plurality of pressure chambers provided on a surface of the substrate and through which a first liquid and a second liquid flow;

a pressure generating element provided on the surface of the substrate and configured to pressurize the first liquid;

a discharge port communicating with at least one of the pressure chambers and through which the second liquid is discharged; and a liquid channel communicating with any one of the pressure chambers, wherein the liquid channel has a first supply channel used to supply the first liquid to a corresponding one of the pressure chambers, a second supply channel used to supply the second liquid to a corresponding one of the pressure chambers, a first collecting channel used to collect the first liquid from a corresponding one of the pressure chambers, and a second collecting channel used to collect the second liquid from a corresponding one of the pressure chambers, in the substrate, a first communication supply channel communicating with the first supply channel via a first communication supply opening and used to supply the first liquid to the first supply channel, a second communication supply channel communicating with the second supply channel via a second communication supply opening and used to supply the second liquid to the second supply channel, a first communication collecting channel communicating with the first collecting channel via a first communication collecting opening and used to collect the first liquid from the first collecting channel, a second communication collecting channel communicating with the second collecting channel via a second communication collecting opening and used to collect the second liquid from the second collecting channel, a first common supply channel communicating with each of a plurality of the first communication supply channels via a first common supply opening and used to supply the first liquid to the plurality of first communication supply channels, a second common supply channel communicating with each of a plurality of the second communication supply channels via a second common supply opening and used to supply the second liquid to the plurality of second communication supply channels, a first common collecting channel communicating with each of a plurality of the first communication collecting channels via a first common collecting opening and used to collect the first liquid from the plurality of first communication collecting channels, and a second common collecting channel communicating with each of a plurality of the second communication collecting channels via a second common collecting opening and used to collect the second liquid from the plurality of second communication collecting channels, are formed, and in the substrate, at least any one of a relationship that a central axis of the first communication supply opening is located closer to the corresponding one of the pressure chambers than a central axis of the first common supply opening, a relationship that a central axis of the second communication supply opening is located closer to the corresponding one of the pressure chambers than a central axis of the second common supply opening, a relationship that a central axis of the first communication collecting opening is located closer to the corresponding one of the pressure chambers than a central axis of the first common collecting opening, and a relationship that a central axis of the second communication collecting opening is located closer to the corresponding one of the pressure chambers than a central axis of the second common collecting opening is satisfied.

2. The liquid discharge head according to claim 1, wherein each of a cross-section area of the first communication supply channel for which the relationship that the central axis of the first communication supply opening is located closer to the corresponding one of the pressure chambers than the central axis of the first common supply opening is satisfied, a cross-section area of the second communication supply channel for which the relationship that the central axis of the second communication supply opening is located closer to the corresponding one of the pressure chambers than the central axis of the second common supply opening is satisfied, a cross-section area of the first communication collecting channel for which the relationship that the central axis of the first communication collecting opening is located closer to the corresponding one of the pressure chambers than the central axis of the first common collecting opening is satisfied, and a cross-section area of the second communication collecting channel for which the relationship that the central axis of the second communication collecting opening is located closer to the corresponding one of the pressure chambers than the central axis of the second common collecting opening is satisfied, is greater than a cross-section area of the liquid channel.

3. The liquid discharge head according to claim 1, wherein the second communication supply channel, the first communication supply channel, the first communication collecting channel, and the second communication collecting channel are arranged in order of the second communication supply channel, the first communication supply channel, the first communication collecting channel, and the second communication collecting channel, and the central axis of the second communication supply opening is located closer to the corresponding one of the pressure chambers than the central axis of the second common supply opening.

4. The liquid discharge head according to claim 3, wherein the central axis of the second communication supply opening is located closer to the corresponding one of the pressure chambers than an extension line of a wall, adjacent to the corresponding one of the pressure chambers, of the second common supply channel.

5. The liquid discharge head according to claim 3, wherein the central axis of the second common supply opening is located closer to the corresponding one of the pressure chambers than the central axis of the second common supply channel.

6. The liquid discharge head according to claim 1, wherein the second communication supply channel, the first communication supply channel, the first communication collecting channel, and the second communication collecting channel are arranged in order of the second communication supply channel, the first communication supply channel, the first communication collecting channel, and the second communication collecting channel, and the central axis of the second communication collecting opening is located closer to the corresponding one of the pressure chambers than the central axis of the second common collecting opening.

7. The liquid discharge head according to claim 1, wherein at least any one of the first communication supply channel, the second communication supply channel, the first communication collecting channel, and the second communication collecting channel is a bend crank channel.

8. The liquid discharge head according to claim 7, wherein the crank channel is a single-bend crank channel.

9. The liquid discharge head according to claim 7, wherein the second communication supply channel, the first communication supply channel, the pressure generating element, the first communication collecting channel, and the second communication collecting channel are arranged in order of the second communication supply channel, the first communication supply channel, the pressure generating element, the first communication collecting channel, and the second communication collecting channel, and the second communication supply channel and the second communication collecting channel each are a bend crank channel.

10. The liquid discharge head according to claim 1, wherein at least one of the first communication supply channel, the second communication supply channel, the first communication collecting channel, and the second communication collecting channel has a linear shape and extends so as to be inclined toward the liquid channel.

11. The liquid discharge head according to claim 10, wherein the second communication supply channel, the first communication supply channel, the pressure generating element, the first communication collecting channel, and the second communication collecting channel are arranged in order of the second communication supply channel, the first communication supply channel, the pressure generating element, the first communication collecting channel, and the second communication collecting channel, and the second communication supply channel and the second communication collecting channel each have a linear shape and extend so as to be inclined toward the liquid channel.

12. The liquid discharge head according to claim 1, wherein the plurality of pressure chambers makes up a first pressure chamber row in which a plurality of the pressure chambers is arranged and a second pressure chamber row in which a plurality of the pressure chambers is arranged next to the first pressure chamber row, and at least any one of the first common supply channel, the second common supply channel, the first common collecting channel, and the second common collecting channel, communicating with first pressure chambers making up the first pressure chamber row, communicates with second pressure chambers making up the second pressure chamber row.

13. The liquid discharge head according to claim 12, wherein in the first pressure chamber row, the second communication supply channel, the first communication supply channel, the pressure generating element, the first communication collecting channel, and the second communication collecting channel are arranged in order of the second communication supply channel, the first communication supply channel, the pressure generating element, the first communication collecting channel, and the second communication collecting channel, and the second common supply channel and the second common collecting channel, communicating with the first pressure chambers, communicate with the second pressure chambers.

14. The liquid discharge head according to claim 1, wherein a viscosity of the second liquid is greater than a viscosity of the first liquid.

15. The liquid discharge head according to claim 1, wherein, in each of the pressure chambers, the first liquid and the second liquid flow next to each other in a direction in which the second liquid is discharged.

16. The liquid discharge head according to claim 1, wherein, in each of the pressure chambers, a flow rate of the second liquid is greater than a flow rate of the first liquid.

17. The liquid discharge head according to claim 1, wherein the first liquid is not included in a liquid discharged from the discharge port.

18. The liquid discharge head according to claim 1, wherein the pressure generating element is configured to generate heat when applied with a voltage to cause film boiling to occur in the first liquid.

19. The liquid discharge head according to claim 1, wherein a liquid-to-liquid interface between the first liquid and the second liquid is formed between the discharge port and the pressure generating element.

* * * * *